US010772436B2

(12) United States Patent
Tadros

(10) Patent No.: US 10,772,436 B2
(45) Date of Patent: Sep. 15, 2020

(54) CONVERTIBLE SOFA BED

(71) Applicant: Michael Monir Tadros, Arlington, TX (US)

(72) Inventor: Michael Monir Tadros, Arlington, TX (US)

( * ) Notice: Subject to any disclaimer, the term of this patent is extended or adjusted under 35 U.S.C. 154(b) by 27 days.

(21) Appl. No.: 16/052,578

(22) Filed: Aug. 1, 2018

(65) Prior Publication Data

US 2019/0038035 A1 Feb. 7, 2019

Related U.S. Application Data

(60) Provisional application No. 62/540,068, filed on Aug. 2, 2017.

(51) Int. Cl.

| | |
|---|---|
| ***A47C 17/175*** | (2006.01) |
| ***A47C 17/22*** | (2006.01) |
| ***A47C 17/165*** | (2006.01) |
| ***A47C 17/23*** | (2006.01) |
| ***A47C 17/16*** | (2006.01) |
| ***A47C 17/20*** | (2006.01) |
| ***A47C 17/17*** | (2006.01) |
| ***A47C 17/207*** | (2006.01) |

(52) U.S. Cl.

CPC ..... *A47C 17/1756* (2013.01); *A47C 17/165* (2013.01); *A47C 17/2076* (2013.01); *A47C 17/225* (2013.01); *A47C 17/16* (2013.01); *A47C 17/17* (2013.01); *A47C 17/20* (2013.01); *A47C 17/23* (2013.01)

(58) Field of Classification Search

CPC ..... A47C 17/1756; A47C 17/2076; A47C 17/225; A47C 17/23; A47C 17/16; A47C 17/161; A47C 17/162; A47C 17/165; A47C 17/17; A47C 17/20; A47C 17/207; A47C 17/2073; A47C 17/1655; A47C 7/68

See application file for complete search history.

(56) References Cited

U.S. PATENT DOCUMENTS

| | | | | |
|---|---|---|---|---|
| 112,031 A * | 2/1871 | Hall | A47C 17/165 5/43 |
| 120,270 A * | 10/1871 | Hall | A47C 17/1655 5/43 |
| 477,421 A * | 6/1892 | Jaekel | A47C 17/165 5/43 |
| 730,392 A * | 6/1903 | Owen | A47C 17/165 5/43 |

(Continued)

FOREIGN PATENT DOCUMENTS

| | | |
|---|---|---|
| CA | 2957289 | 3/2016 |
| CN | 203897819 | 10/2014 |

(Continued)

*Primary Examiner* — Nicholas F Polito
*Assistant Examiner* — Morgan J McClure
(74) *Attorney, Agent, or Firm* — Klein, O'Neill & Singh, LLP

(57) ABSTRACT

A sofa bed traversable between a sofa and bed configurations is disclosed herein. It has a folding mechanism having first and second pairs of link members rotatably attached to a backrest and support members on left and right sides of the back rest. Via the first and second link members, the back rest is transitionable between the sofa configuration and the bed configuration. A seat base is movable up and down at an angle via a sliding mechanism.

15 Claims, 19 Drawing Sheets

(56) References Cited

U.S. PATENT DOCUMENTS 791,717 A * 6/1905 Owen ..... A47C 17/165 5/160
791,718 A * 6/1905 Owen ..... A47C 17/165 5/43
791,719 A * 6/1905 Owen ..... A47C 17/165 5/43
891,351 A * 6/1908 Mayer ..... A47C 17/165 403/315
947,298 A * 1/1910 Deimel ..... A47C 17/1655 5/285
1,014,535 A * 1/1912 Sweeney ..... A47C 17/165 5/43
2,330,059 A * 9/1943 Krakauer ..... A47C 17/1756 5/47
2,435,936 A * 2/1948 Wilson ..... A47C 17/1756 5/47
2,437,949 A * 3/1948 Fox ..... A47C 17/1756 5/47
2,534,175 A * 12/1950 Lorenz ..... A47C 17/165 5/43
2,534,176 A * 12/1950 Lorenz ..... A47C 17/165 5/43
2,629,883 A * 2/1953 Nowell ..... A47C 17/1756 16/302
2,634,429 A * 4/1953 Hopeman, Jr. ..... A47C 17/165 297/118
2,672,626 A * 3/1954 Watt ..... A47C 17/1756 235/145 R
2,714,729 A * 8/1955 Bohnsack ..... A47C 17/165 5/43
3,085,257 A * 4/1963 Laemmle ..... A47C 17/161 5/29
3,247,527 A * 4/1966 Mizelle ..... A47C 17/17 5/48
5,104,182 A * 4/1992 Rasnick ..... A47C 7/62 297/113
5,522,102 A 6/1996 Vayda
5,524,959 A * 6/1996 Scott ..... A47C 7/68 297/125
5,601,348 A 2/1997 Minkovski
5,652,978 A 8/1997 Wiig
6,341,392 B1 * 1/2002 Makinen ..... A47C 17/1753 5/43
6,405,392 B2 6/2002 Schwalbe, Jr.
6,651,274 B2 * 11/2003 Swihart ..... A47C 17/1756 5/37.1
6,779,208 B2 * 8/2004 Lim ..... A47C 17/20 5/136
7,013,506 B2 3/2006 Revels
7,231,675 B1 6/2007 Rucinski et al.
7,607,180 B2 * 10/2009 Griepentrog ..... A47C 17/165 5/43
7,669,254 B2 3/2010 Mortimer-McKenzie
8,209,797 B2 7/2012 Swierski et al.
9,314,104 B2 * 4/2016 Stieglitz ..... A47C 7/506
9,414,688 B2 8/2016 Gardner
9,622,587 B2 4/2017 Murphy
9,668,585 B2 6/2017 Garland
9,895,002 B1 * 2/2018 Cooke ..... A47C 17/165
10,085,567 B1 * 10/2018 Reyes ..... A47C 17/213
2006/0096027 A1 * 5/2006 Thurow ..... A47C 17/1756 5/37.1
2008/0148478 A1 * 6/2008 Patella ..... A47C 17/16 5/38
2012/0131745 A1 * 5/2012 Wieland ..... A47C 7/506 5/2.1
2013/0047333 A1 * 2/2013 Wieland ..... A47B 83/04 5/3
2015/0026881 A1 1/2015 Nault
2015/0040314 A1 2/2015 Cabrera et al.
2015/0067963 A1 * 3/2015 Grimoldi ..... A47C 17/165 5/37.1
2015/0305513 A1 10/2015 Tiffany
2016/0037933 A1 2/2016 Grossman et al.
2016/0051057 A1 2/2016 Murphy
2016/0150888 A1 6/2016 Thurow
2016/0183688 A1 * 6/2016 Thurow ..... A47C 17/17 5/13
2016/0213156 A1 7/2016 Angle et al.
2016/0242555 A1 * 8/2016 Aigner ..... A47C 7/407
2016/0242560 A1 * 8/2016 Aigner ..... A47C 7/407
2017/0071353 A1 3/2017 Murphy
2018/0116410 A1 * 5/2018 Ritter ..... A47C 17/213

FOREIGN PATENT DOCUMENTS

DE 202014004234 7/2014
DE 201420104092 10/2014
DE 202014006997 11/2014
DE 102015001123 3/2016
EP 2898796 7/2015
EP 2801294 3/2016

* cited by examiner

CONVERTIBLE SOFA BED

CROSS-REFERENCE TO RELATED APPLICATIONS

The present application claims priority to U.S. Provisional Application No. 62/540,068 filed on Aug. 2, 2017, the disclosure of which is incorporated herein by reference.

STATEMENT RE: FEDERALLY SPONSORED RESEARCH/DEVELOPMENT

Not Applicable

BACKGROUND

The embodiments and aspects described herein relate to a sofa bed with a folding mechanism that facilitates conversion from a sofa to a bed, and vice versa.

Folding beds, particularly sofa beds, have been desirable in tight living spaces where utilizing a single living space for multiple purposes may be optimal to save space. However, there are various deficiencies in current folding beds, including the compromise of either giving up comfort for space or practicality for comfort in an attempt to be functional in tight spaces or multipurpose rooms. Thus, there is a need for an improved sofa bed.

Accordingly, there is a need in the art for a sofa bed that improves on the practicality and comfort of current sofa beds.

BRIEF SUMMARY

The various embodiments and aspects described herein address the needs discussed above, discussed below, and those that are known in the art.

The present disclosure is directed to a sofa bed having one or more mechanisms (e.g., a folding mechanism and a sliding mechanism) that allow the sofa bed in sofa configuration to have a backrest and seat portion so that the sofa bed can be used as a sofa, and allow the sofa bed to be traversed to a bed configuration to have a conventional mattress that stays locked in place. Additionally, a benefit of the sofa bed is that the sofa bed described herein with a standard twin or twin xl mattress does not require any sort of anchoring of a frame of the sofa bed to a wall or floor.

There may be a convertible sofa bed with a folding mechanism capable of traversing the sofa bed between a sofa configuration and a bed configuration. The sofa bed may have a left support member and a right support member, both configured to rest on an underlying surface, a backrest having a left end and a right end. The backrest may be horizontally disposed between the left support member and the right support member, wherein the left end is attached to the left support member and the right end is attached to the right support member. The backrest may be configured to pivot up when the sofa bed is traversed to the sofa configuration and may pivot down when the sofa bed is traversed to the bed configuration. The backrest may have a front side and a rear side. The rear side may define a bed frame. The bed frame may be engageable with a mattress. The sofa bed may further have a seat base having a left end and a right end attached to the backrest. The seat base is receptive to at least one seat cushion.

The folding mechanism of the sofa bed may have a left first link member rotatably attached to the left backrest end and the left support member, and a right first link member rotatably attached to the right backrest end and the right support member. The left and right first link members may push upward on the backrest when the sofa bed is in the bed configuration. The left and right first link members may be shorter than the left and right second link members. The folding mechanism may further have a left second link member rotatably attached to the left backrest end and the left support member and a right second link member rotatably attached to the right backrest end and the right support member. The pivot points of the rotatable attachment of the left and right first link members to the left and right backrest ends may be at a first height above the underlying surface and the pivot points of the rotatable attachment of the left and right second link members to the left and right backrest end may be at a second height, the first and second heights being within 3 inches of each other. The first and second heights may be equal to each other. The left and right first link members may be about 3.5 inches. The left and right second link members may be about 6.5 inches. The left and right second link members may be about twice in length than that of the left and right first link members. The left and right second link members may push downward on the backrest when the sofa bed is in the bed configuration.

The sofa be may further have a left front link member rotatably attached to the left backrest end and the left seat base end and a right front link member rotatably attached to the right backrest end and the right seat base end. The left and right front link members may be between about 6 inches and 18 inches. When the sofa bed is traversed to a bed configuration or a sofa configuration, the left front link member and the right front link member may be configured to rock about the seat base, and the backrest may be configured to rotate about the left link member and the right link member. The pivot points of the rotatable attachment of the left and right front link members to the left and right backrest ends may be at a first height above the underlying surface and the pivot points of the rotatable attachment of the left and right front link members to the left and right seat base ends may be at a second height, where the first height may be higher than the second height.

The sofa bed may further have a sliding mechanism. The sliding mechanism may have left first and second track members connecting the left seat base end to the left support member, and right first and second track members connecting the right seat base end to the right support member. The left and right track members may be parallel to each other. The left and right first and second track members may be left and right first and second rails that are receptive to left and right first and second sliding members that are slidably engageable with the left and right first and second rails. The left first and second rails may be mounted on an inner surface of the left support member and the right first and second rails may be mounted on an inner surface of the right support member. The left and right first rails and the left and right second rails may be parallel to each other and at an angle to a vertical plane. The left first and second sliding members may be mounted on the left seat base end and the right first and second sliding members may be mounted on the right seat base end. The left and right first sliding members and the left and right second sliding members may also be parallel to each other at the angle to the vertical plane. The mounting angle of the left and right first and second rails and the first and second sliding members may be between about 6 degrees to 20 degrees. The left and right first and second rails may be of equal length. Further, the sliding mechanism may be lockable with a optional stopping mechanism. The stopping mechanism may be a spring loaded latch.

In bed configuration, the left and right first and second link members may create a reaction force couple that counters a summation of moments created by the weight of the seat base, weight of the backrest, and a weight of a person resting on the backrest so that the sofa bed remains in the bed configuration. The left and right first link members may be vertical and parallel to the left and right second link members to lock the backrest at the bed configuration. In sofa configuration, the seat base may optionally be locked at the sofa configuration by means of a locking mechanism. Also, even without a locking mechanism, a summation of the weights of the backrest, and the mattress, may be more than the weight of the seat base so that the backrest stays in the sofa configuration as well.

There may further be a method of traversing a convertible sofa bed with a folding mechanism from a sofa configuration to a bed configuration. The method may include a set of steps, wherein a first step may be unlocking a lock that holds a seat base and a backrest at a sofa configuration. The lock may be unlocked by disengaging a spring loaded latch from a latch slot. A second step may be rotating a backrest having a rear side defining a bed frame to a horizontal position so that the rear side faces upwards. An application of a horizontal pulling force on the backrest, or a downward force on the seat base, may be necessary to initiate the rotation of the backrest. The rotating step may be aided by left and right front link members connecting the backrest to the seat base rocking towards the seat base and rotating the backrest and left and right first and second link members attached to the left and right backrest ends to oscillate the backrest about a left joint and a right joint that join the left and right backrest ends to the left and right second link members and a left joint and a right joint that join the left and right backrest ends to the left and right first link members until the backrest is horizontal. A third step may be lowering the seat base so that the backrest is disposed above the seat base when the sofa bed is in the bed configuration. Lowering the backrest and seat base may be assisted by a spring so that a weight of the seat base does not cause the backrest and the seat base to inadvertently and too quickly drop to the bed configuration. For example, spring (e.g., gas spring, coil spring, elastic member, . . . etc.) may be connected to the back rest and the arm rest. A fourth step may be positioning left and right first link members vertical and parallel to left and right second link members to lock the bed frame at the bed configuration.

As indicated above, the application of a horizontal pulling force on the backrest or a downward force on the seat base, may be necessary to initiate the rotation of the backrest. The downward force on the seat base can unlock the back rest in that the downward force on the seat base has a horizontal force component in the same direction as that as arrow. In this regard, the downward force will also move the backrest laterally in the direction of arrow and skew the link members as discussed herein to unlock the backrest.

Additionally, there may be a method of traversing a convertible sofa bed with a folding mechanism from a bed configuration to a sofa configuration. The method may include a set of steps, wherein a first step may be pulling a bed frame defined by a backrest laterally to orient left and right first link members to left and right second link members for unlocking the sofa bed from the bed configuration. The bed frame may be pulled until the left and right first link members are no longer at a 90-degree angle to a horizontal plane. Pulling the bed frame may involve applying a force on the bed frame that has a horizontal magnitude. A second step may be rotating the bed frame upward. Rotating the bed frame upward may involve applying a force on the bed frame that has a vertical magnitude. A third step may be raising a seat base. The seat base may be raised by sliding left and right first and second sliding members at an angle to the vertical plane along left and right first and second rails. The step of raising the seat base may be assisted by a link. Optionally, a spring may be used to help with the transition of the sofa bed to the sofa configuration. A fourth step may be locking the seat base and the backrest to a sofa configuration. The seat base may be locked by engaging a spring loaded latch with a latch slot.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The various aspects of the sofa bed described herein may relate to a sofa bed wherein the sofa bed is convertible between a sofa configuration and a bed configuration. In the bed configuration, the sofa bed is placed into a position where a user can lay down on a standard mattress (e.g., twin or twin xl). In the sofa configuration, the mattress is moved out of the way so that the user can sit on seat cushions. The sofa bed does not require that a frame of the sofa bed be anchored to a floor or wall.

FIGS. 1-4 show a perspective and skeleton view of a sofa bed 10 in sofa configuration (see FIG. 1), transition configuration (see FIGS. 2-3), and bed configuration (see FIG. 4) resting on an underlying surface 12 with left and right support members 20, 22, which may also be referred to as left and right armrests 20, 22. It will be appreciated that the term "armrest" is for exemplary purposes only and not intended to be limiting. It is expressly contemplated that the sofa bed 10 may have left and right support members 20, 22 that are not armrests. The support members or armrests 20, 22 may be constructed out of one or a combination of materials commonly used in building sofa frames such as wood, artificial wood, molded plastic, aluminum and steel or any other durable, flexible, and/or resilient material. The armrests 20, 22 may be further padded and layered with linen fabric, corduroy, or leather depending on stylistic and comfort needs. Materials such as foam, down, feathers, fabric or a combination thereof may be utilized as padding.

Figure 16:
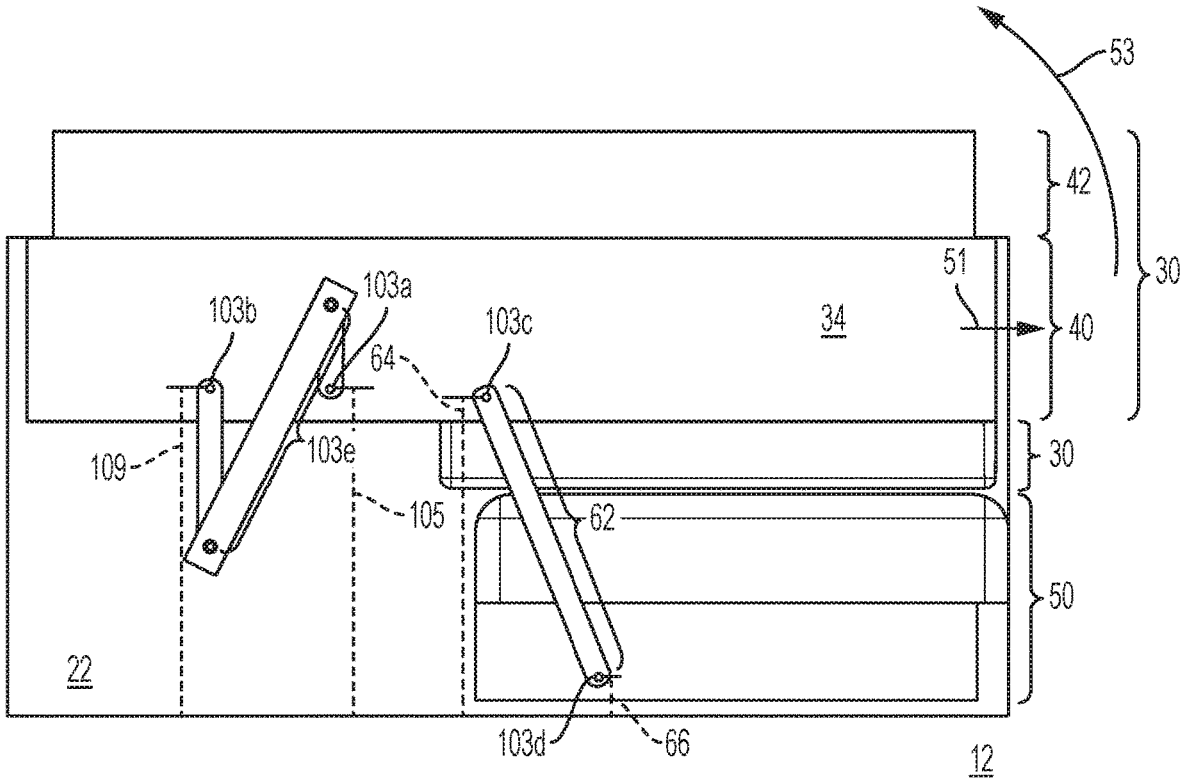
FIG. 16 is a side view of the sofa bed shown in FIG. 15 in bed configuration.
Figure 17:
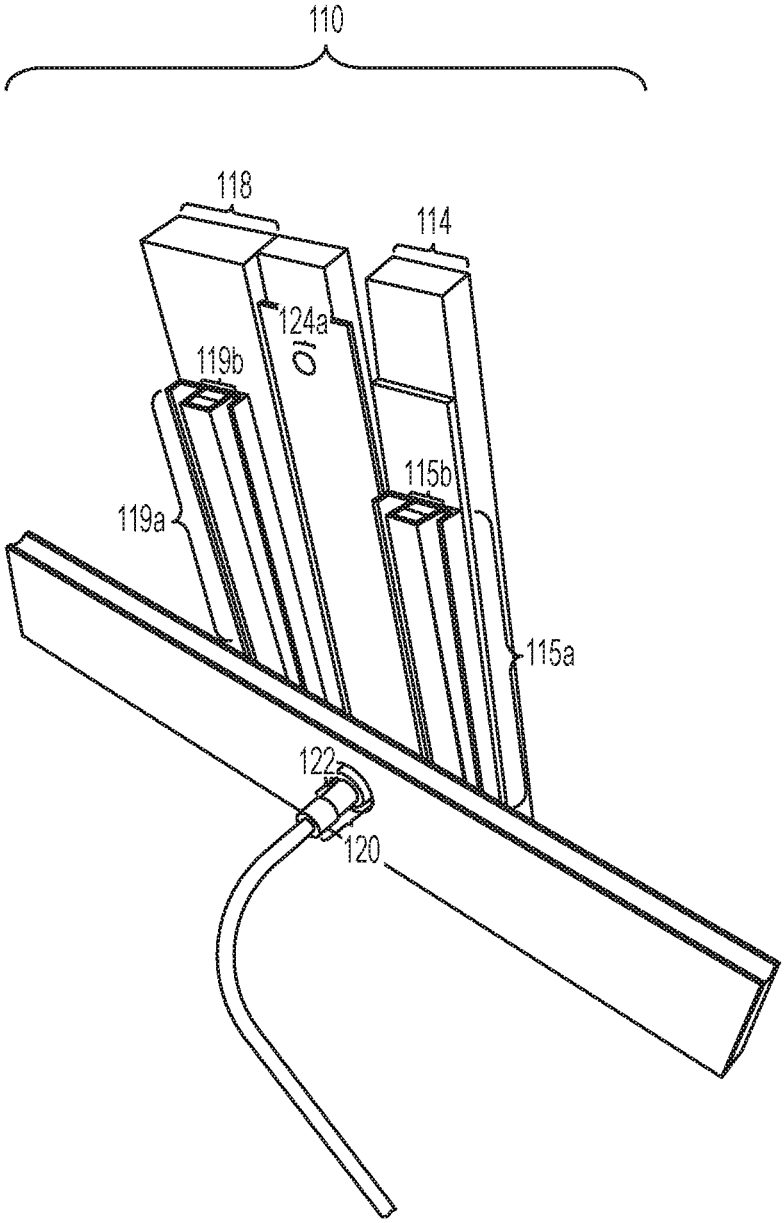
FIG. 17 is a perspective view of a sliding mechanism of the sofa bed in bed configuration, as shown in FIGS. 4 and 15.
Figure 18:
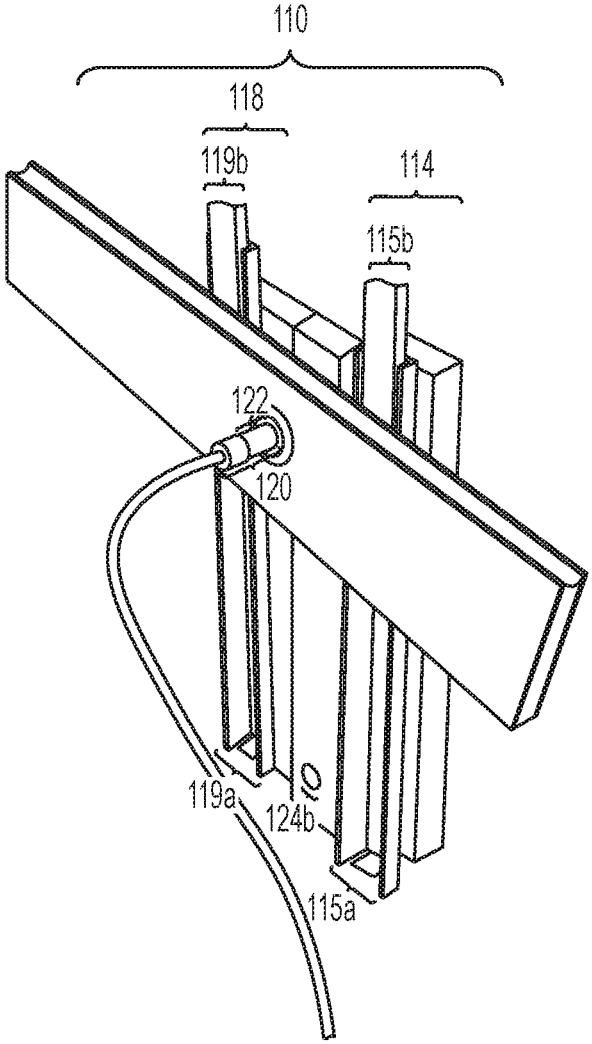
FIG. 18 is a perspective view of the sliding mechanism shown in FIG. 17 of the sofa bed in sofa configuration, as shown in FIGS. 1 and 5.

The sofa bed 10 may have a backrest 30 (see FIGS. 1 and 2), a seat base 50 (see FIGS. 1 and 2), a folding mechanism 100 (see FIG. 5), and a sliding mechanism 110(see FIG. 17). FIGS. 5-16 show the folding mechanism 100, and FIGS. 17 and 18 show the sliding mechanism 110 in further detail and how they function, which will be discussed below. The backrest 30 and the seat base 50 may be constructed out of one or a combination of materials commonly used in building sofa frames such as wood, artificial wood, molded plastic, steel or any other durable, flexible, resilient metal. Preferably, the backrest 30 may have a width of between about 30 to 60 inches (preferably 40 inches). The seat base 50 may have a width of between about 18 to 30 inches (preferably about 24 inches). Other dimensions are also contemplated. The folding mechanism 100 and sliding mechanism 110 may be constructed out of a load bearing material such as wood, steel, plastic, metal, any material with similar mechanical properties, or a combination thereof.

Figure 1:
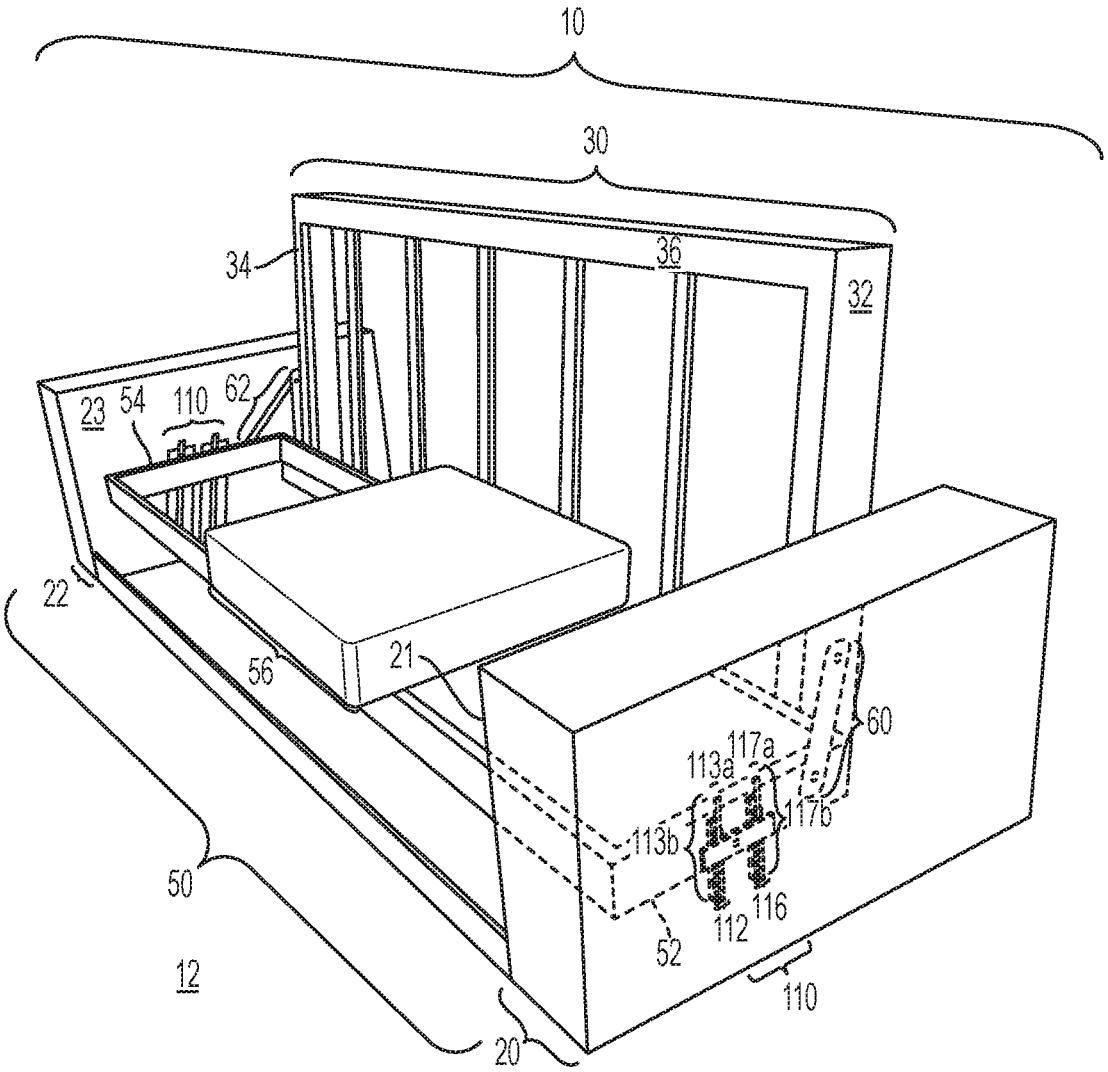
FIG. 1 is a perspective skeleton view of a sofa bed in sofa configuration.
Figure 2:
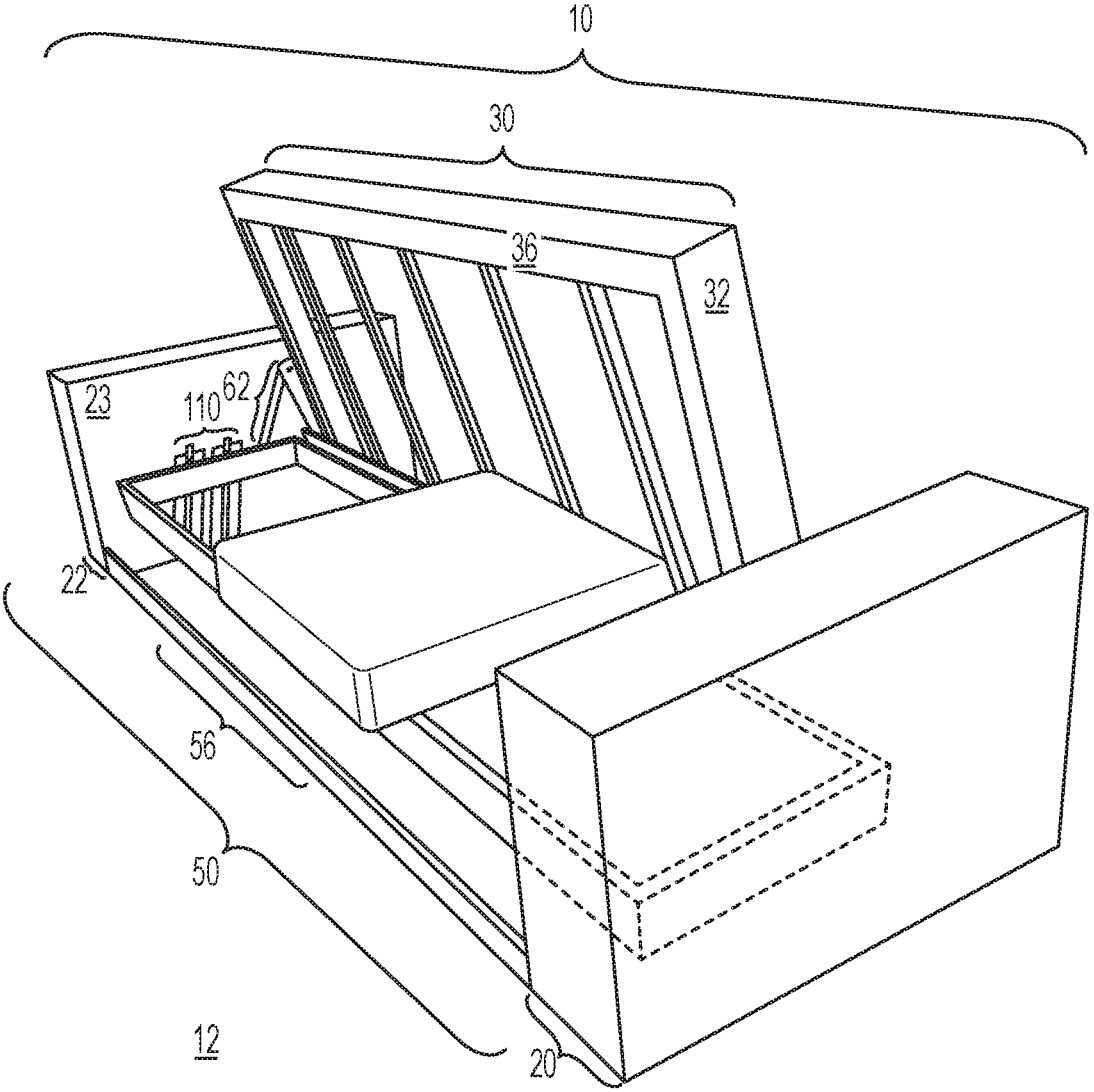
FIG. 2 is a perspective skeleton view of the sofa bed shown in FIG. 1. having begun its conversion to bed configuration.
Figure 3:
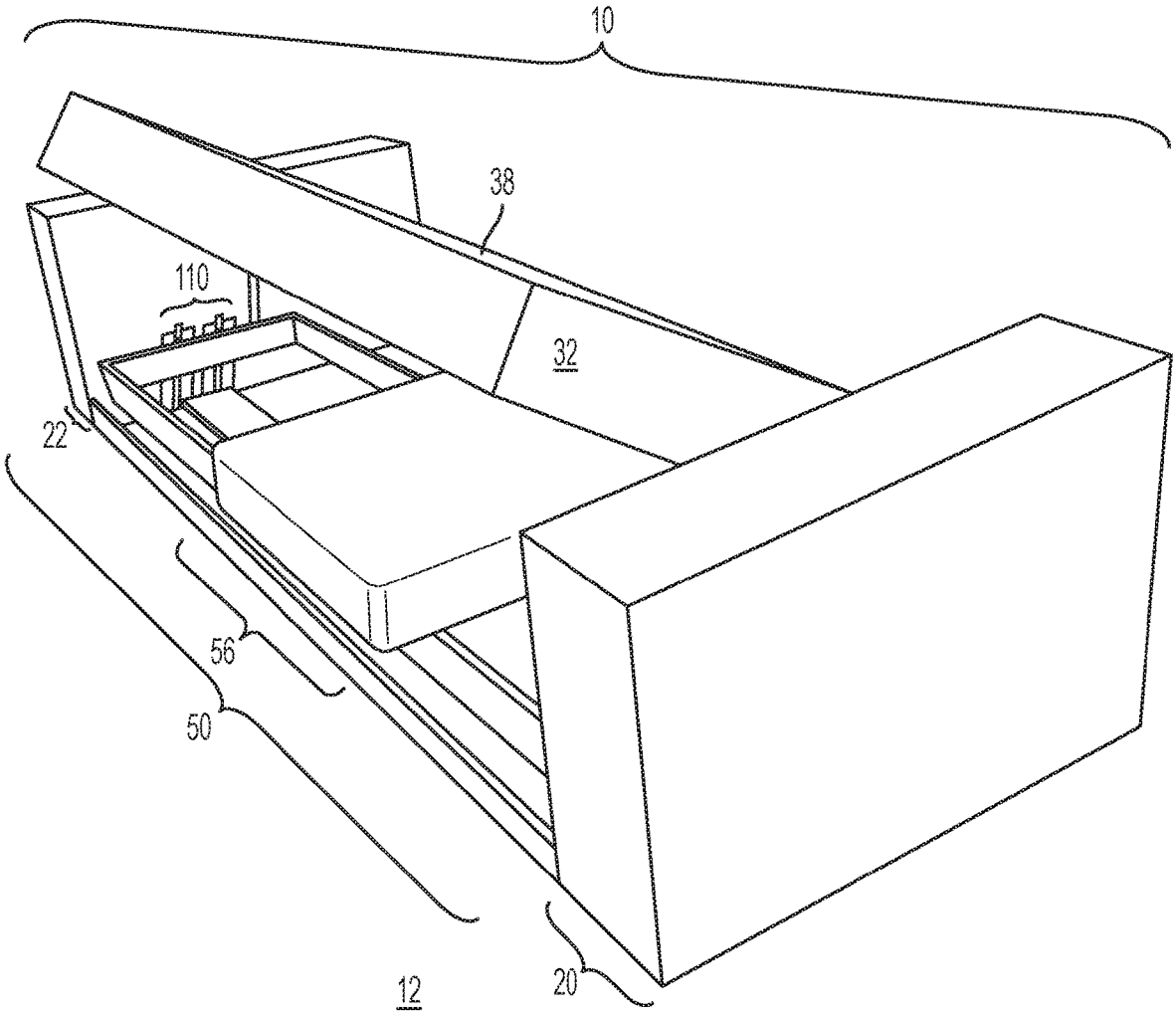
FIG. 3 is a perspective skeleton view of the sofa bed shown in FIG. 2. further into its conversion to bed configuration.
Figure 4:
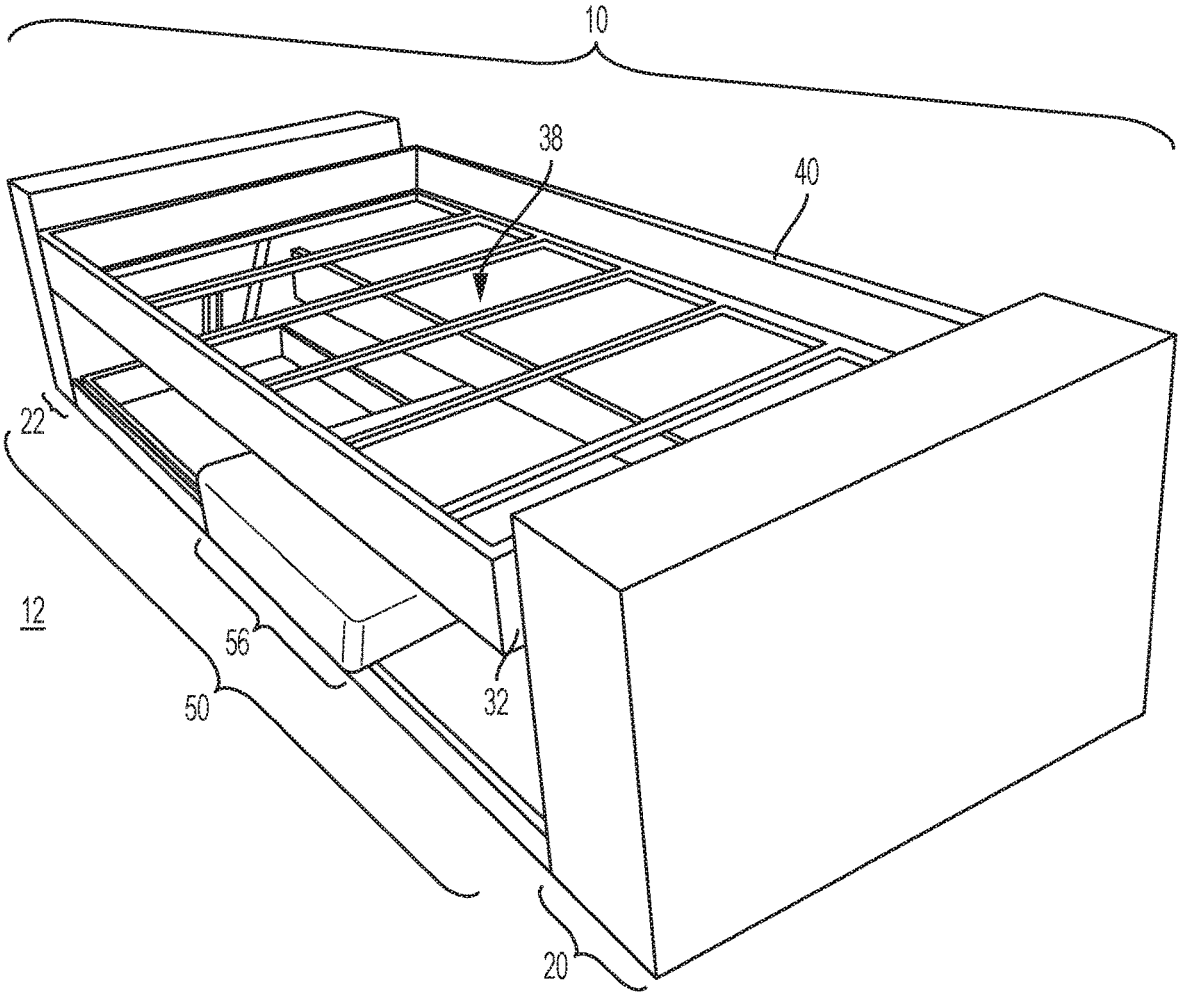
FIG. 4 is a perspective skeleton view of the sofa bed shown in FIG. 1 in bed configuration.

Also shown in FIG. 4, the rear side 38 of the backrest 30 may include a bed frame 40. The bed frame 40 may receive a bed. The rear side 38 may be flat wood, a wire spring grid, or incorporate other suspension arrangements known to one of ordinary skill in the art. The bed frame 40 may hold a mattress 42. The bed frame 40 shown in FIG. 4 is shown with side support, but that is optional. The bed frame 40 may be flat without side supports. The height of the backrest 30 may depend on the thickness of the mattress 42 held by the bed frame 40. Preferably, the backrest 30 may have a height between about 4 to 16 inches. The bed frame 40 may have ribbed inner walls to secure the mattress 42 in place to prevent the mattress 42 from falling out of the bed frame 40 when the sofa bed 10 is in sofa configuration, and when the sofa bed 10 is being transitioned into a bed configuration. The bed frame 40 may further utilize other fastening mechanisms known in the art to hold the mattress 42 such as hooks and loops, hooks, or string ties. The mattress 42 may be one of a range of commercially available mattresses such as innerspring, memory foam, latex, or gel. The combination of type of mattress 42 and rear side 38 may be chosen by the user based on comfort, health issues, or the need to be cost-effective. The mattress 42 size may be twin xl or twin, which are standard mattress size terms used in the art. Two or more sofa beds 10, in bed configuration may be joined side-to-side to form a queen, king, or California king size bed.

The length of the backrest 30 may be between about 70 inches and 90 inches, depending on the mattress size the bed frame 40 can accommodate. The seat base 50 may be suitable to put seat cushions 56 on. The seat cushions 56 may be a single piece or multiple pieces and cover the entirety of the seat base 50, and may have padding made of foam, down, feathers, fabric or a combination thereof and may have a linen fabric, corduroy, or leather cover. The height of the seat base 50 may depend on the thickness of the seat upholstery, or cushions 56. The length of the seat base 50 may be equal to that of the backrest 30. The length of the seat base 50 may be between about 70 inches and 90 inches. When the sofa bed is in the bed configuration, the mattress support surface may be between about 12 and 20 inches and preferably 16 inches above the underlying surface 12. This is so that a standard twin or twin xl size mattress may have a top surface upon which the person sleeps upon be about 20 to 32 inches (preferably about 24-27 inches) above the underlying surface 12.

Figure 5:
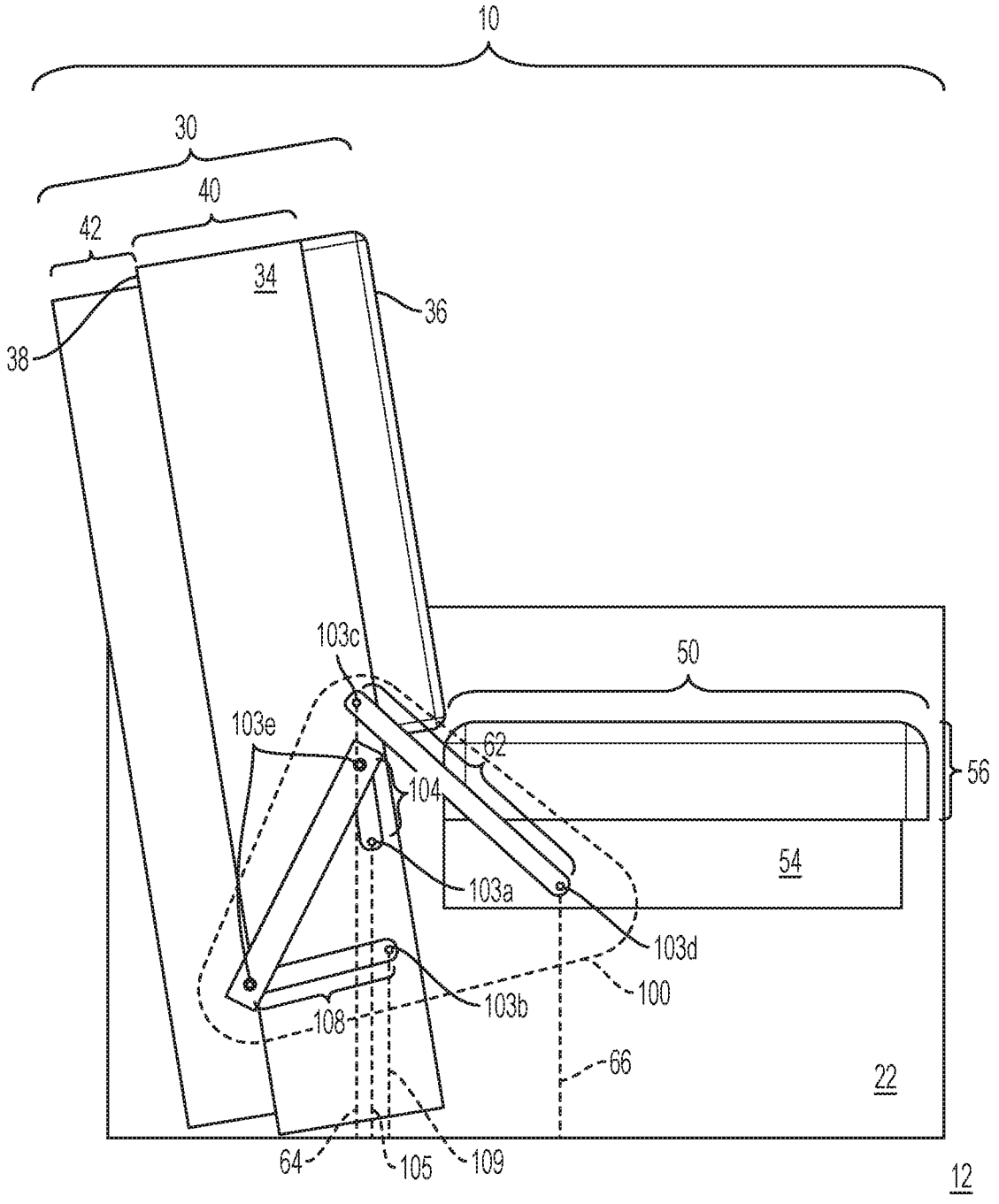
FIG. 5 is a side view of the sofa bed shown in FIG. 1 with a transparent right support member and in sofa configuration.
Figure 6:
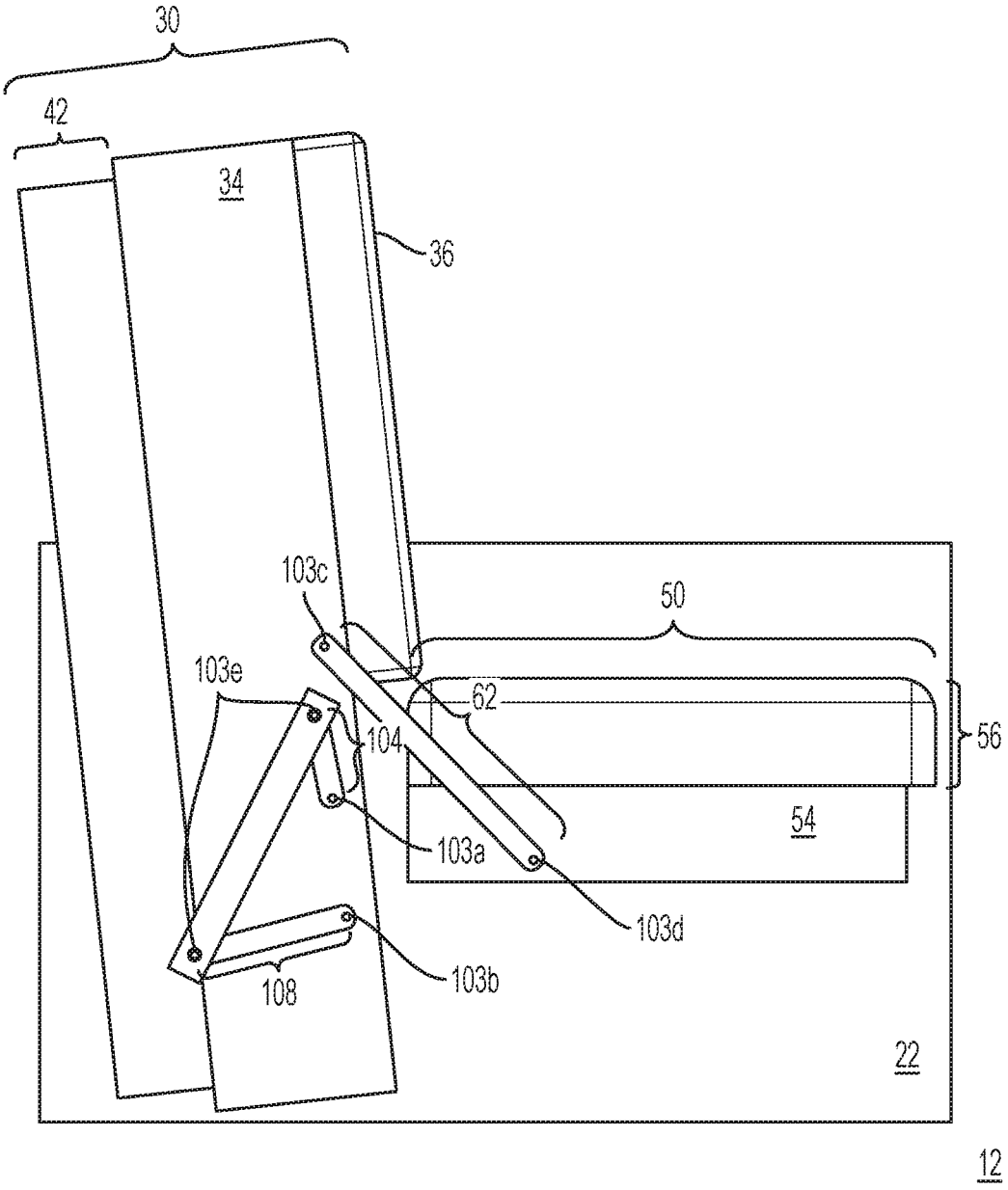
FIG. 6 is a side view of the sofa bed shown in FIG. 5 about having begun its conversion to bed configuration.
Figure 7:
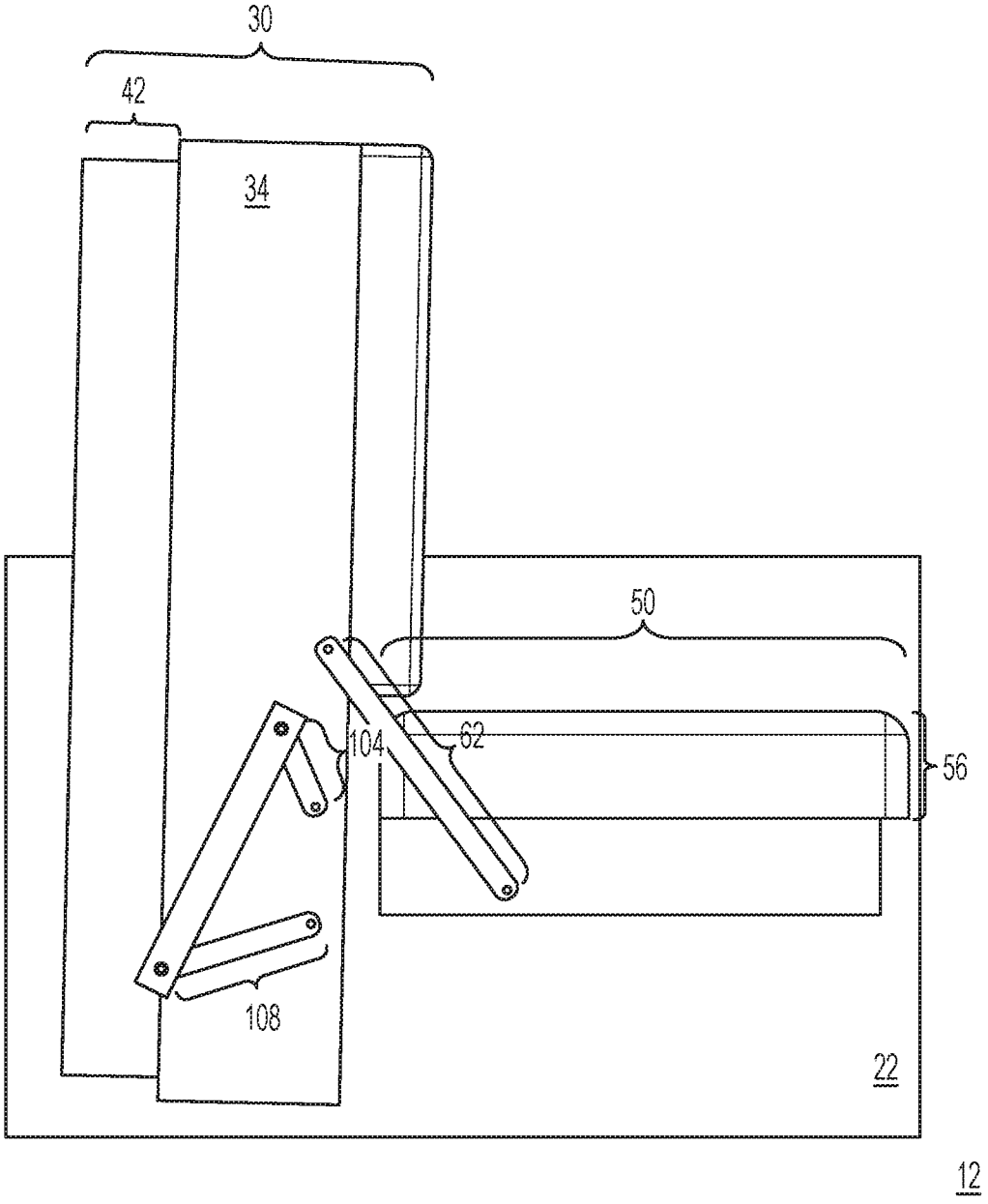
FIG. 7 is a side view of the sofa bed shown in FIG. 6 further into its conversion to bed configuration.
Figure 8:
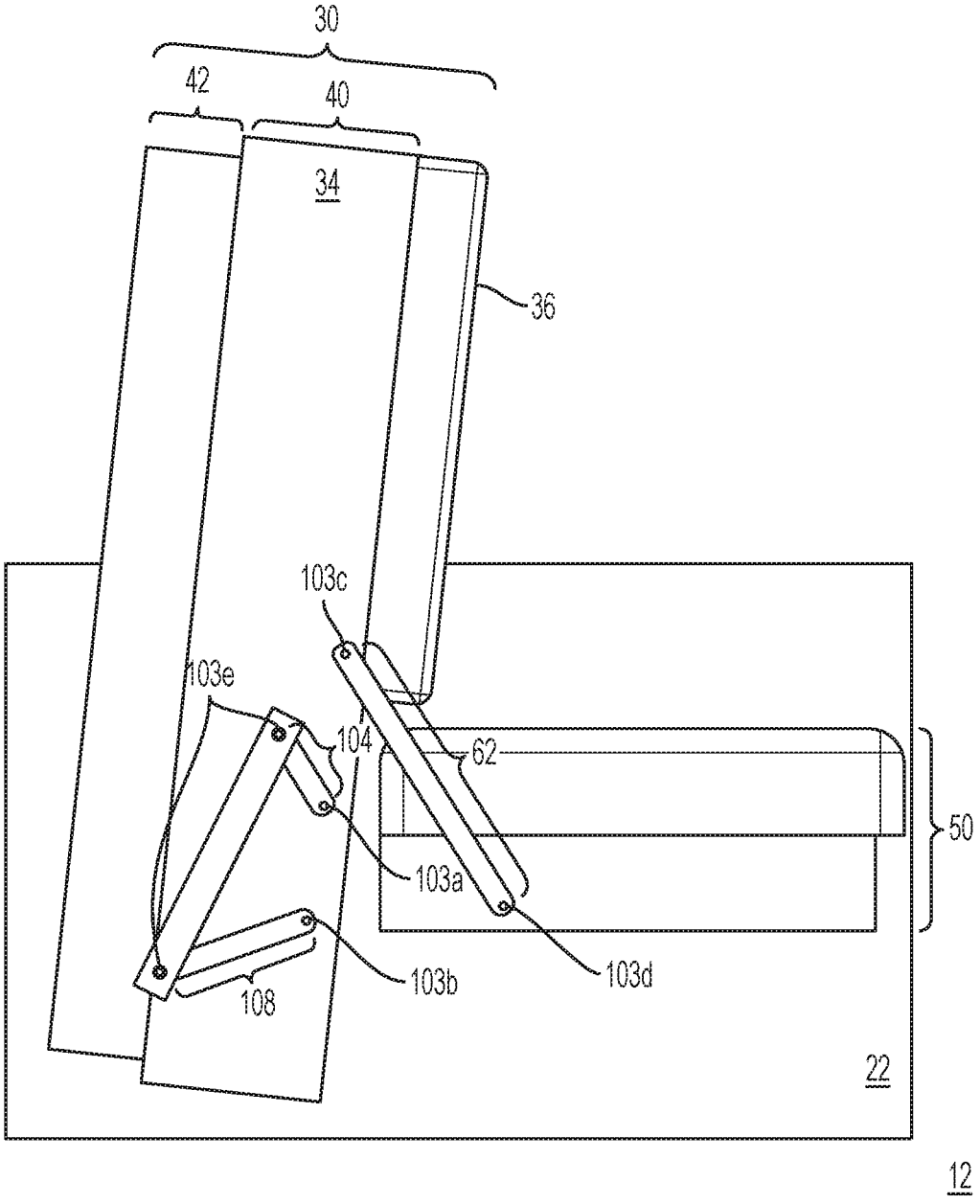
FIG. 8 is a side view of the sofa bed shown in FIG. 7 further into its conversion to bed configuration.
Figure 9:
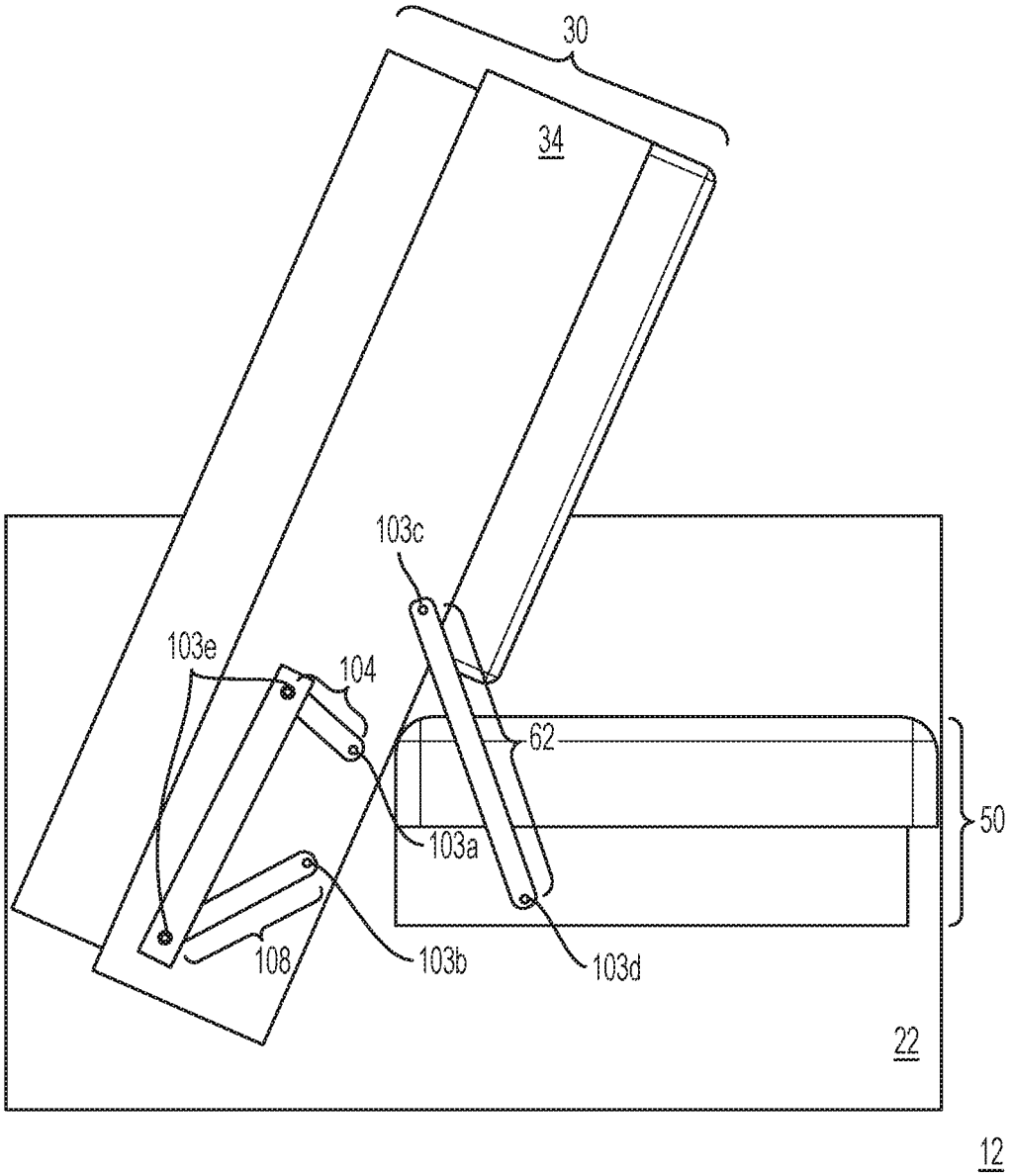
FIG. 9 is a side view of the sofa bed shown in FIG. 8 further into its conversion to bed configuration.
Figure 10:
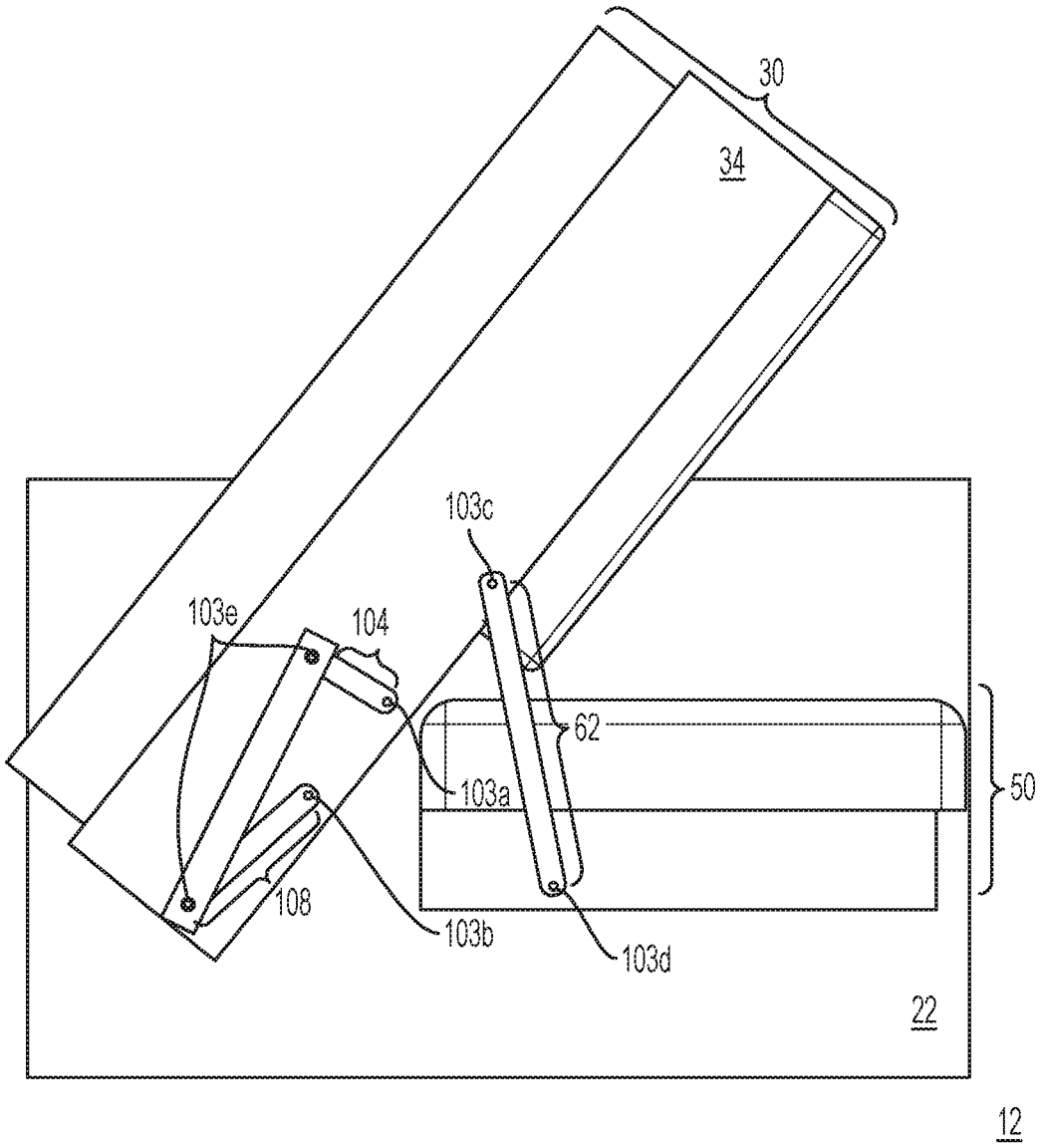
FIG. 10 is a side view of the sofa bed shown in FIG. 9 further into its conversion to bed configuration.
Figure 11:
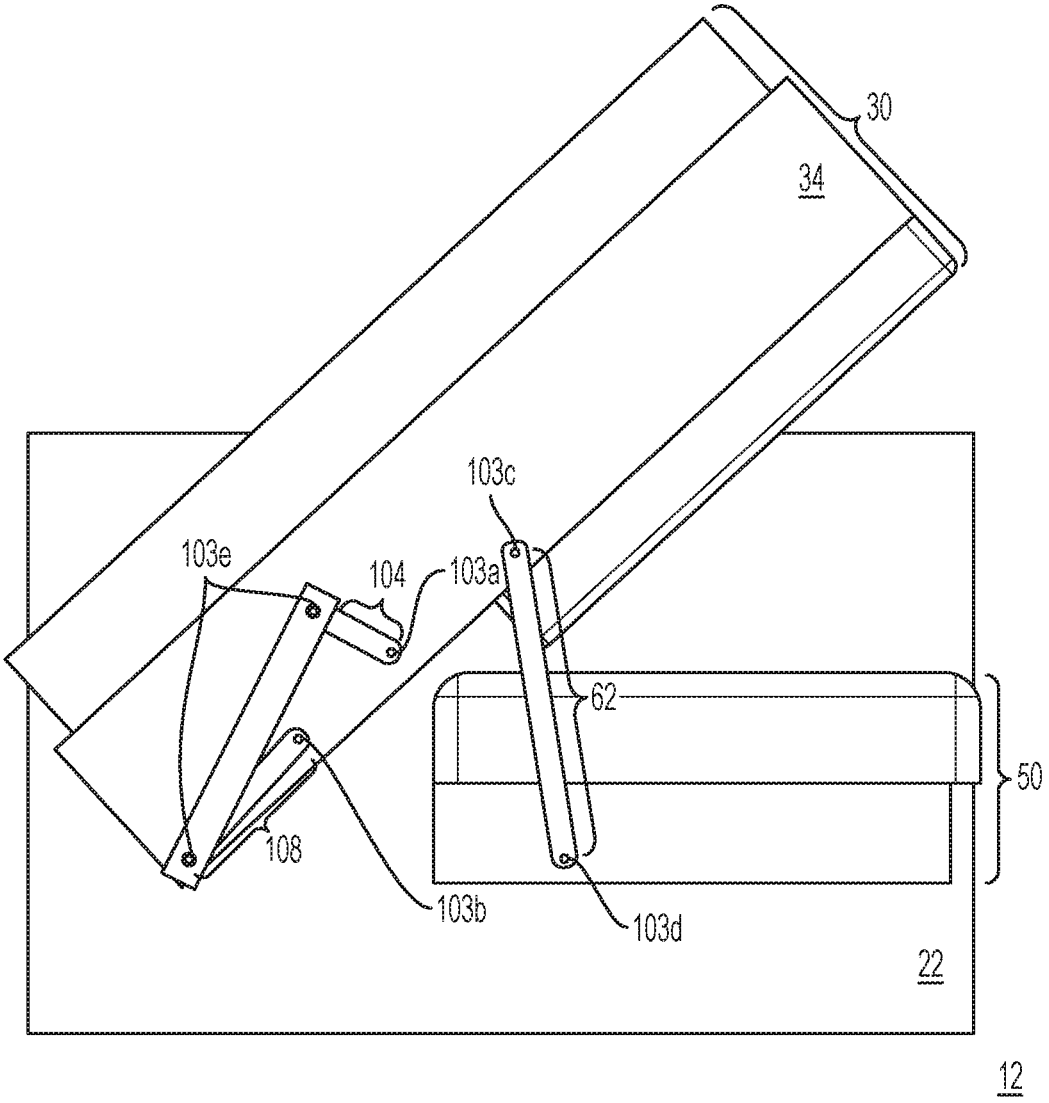
FIG. 11 is a side view of the sofa bed shown in FIG. 10 further into its conversion to bed configuration.
Figure 12:
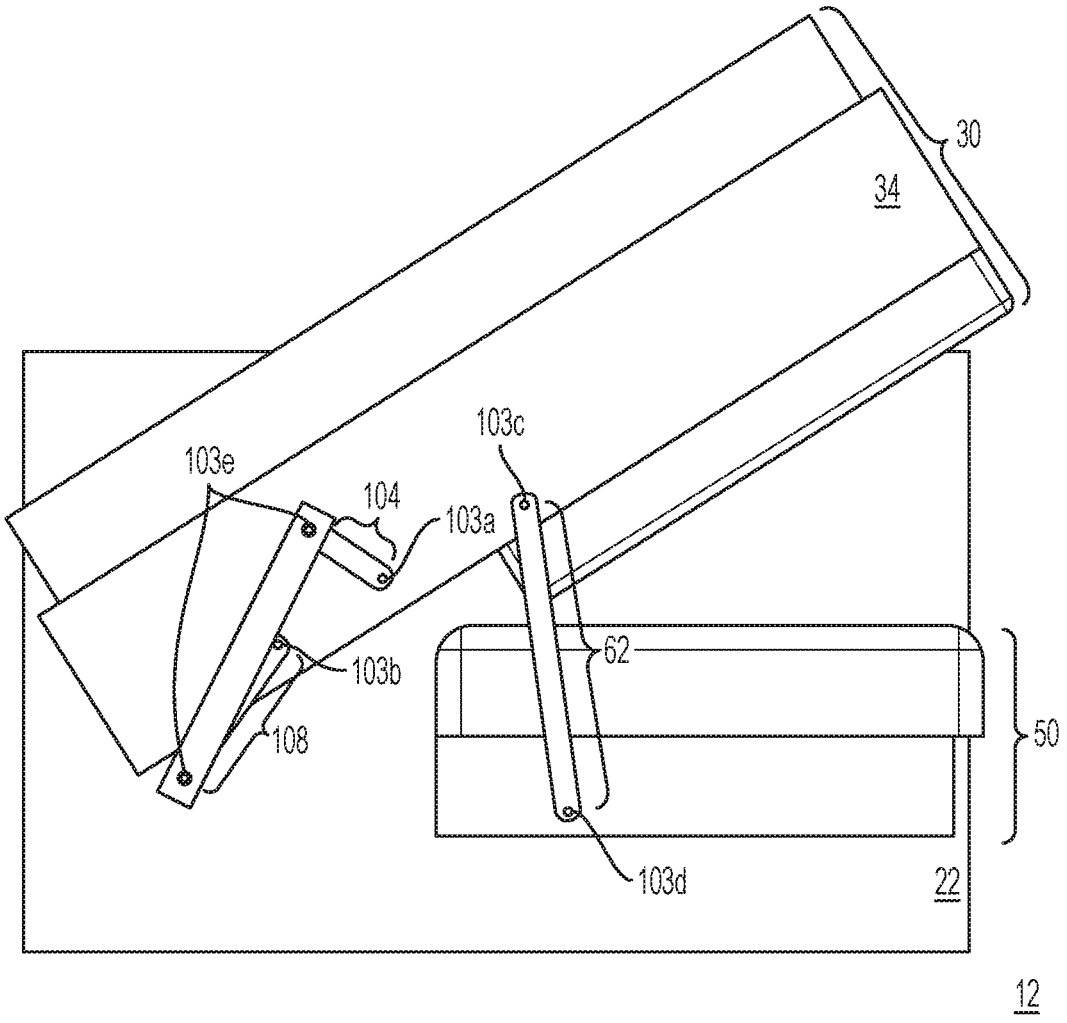
FIG. 12 is a side view of the sofa bed shown in FIG. 11 further into its conversion to bed configuration.
Figure 13:
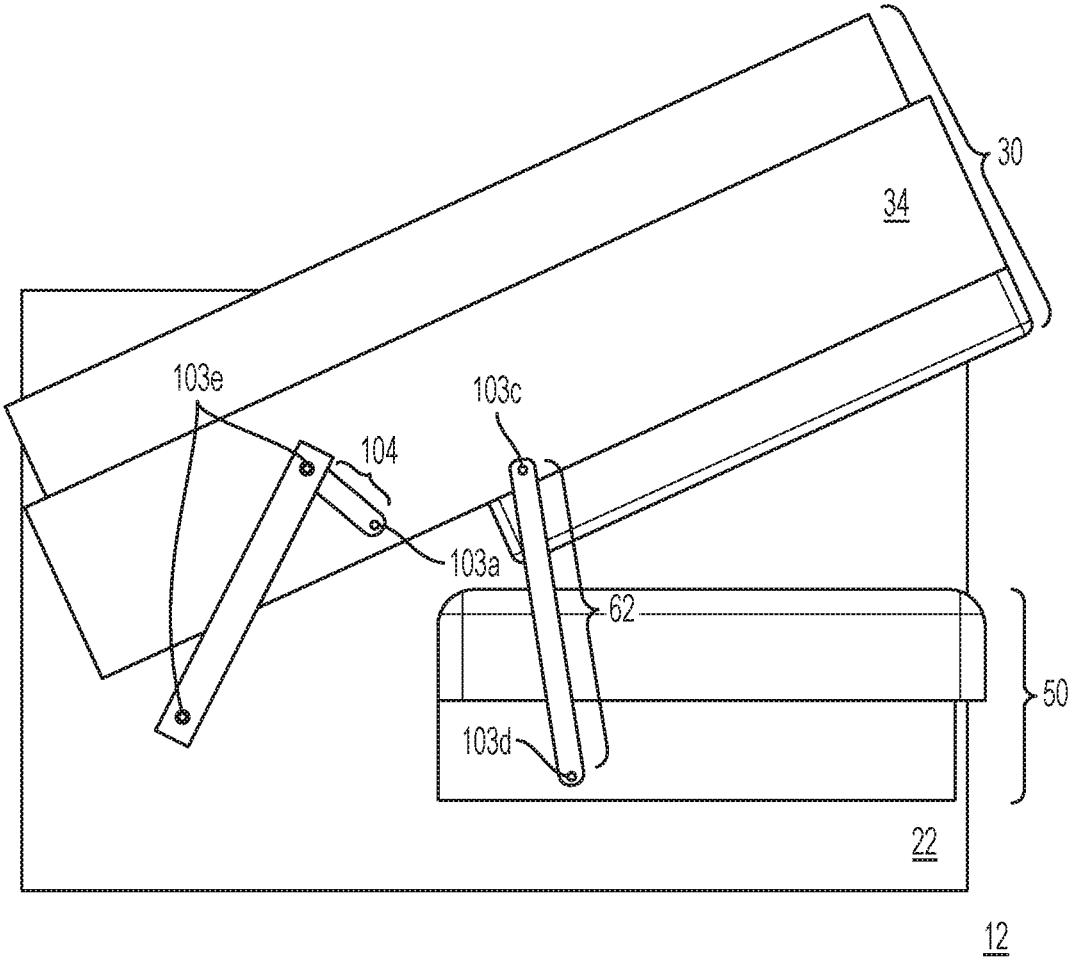
FIG. 13 is a side view of the sofa bed shown in FIG. 12 further into its conversion to bed configuration.
Figure 14:
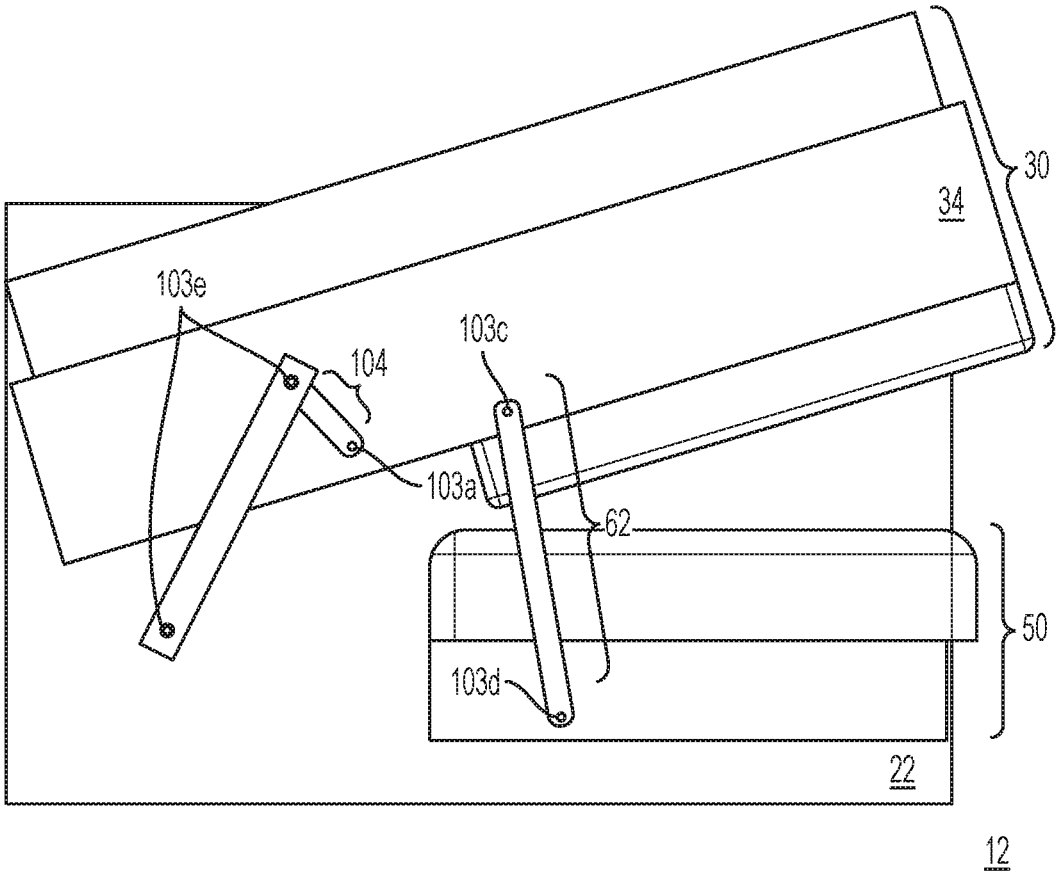
FIG. 14 is a side view of the sofa bed shown in FIG. 13 further into its conversion to bed configuration.
Figure 15:
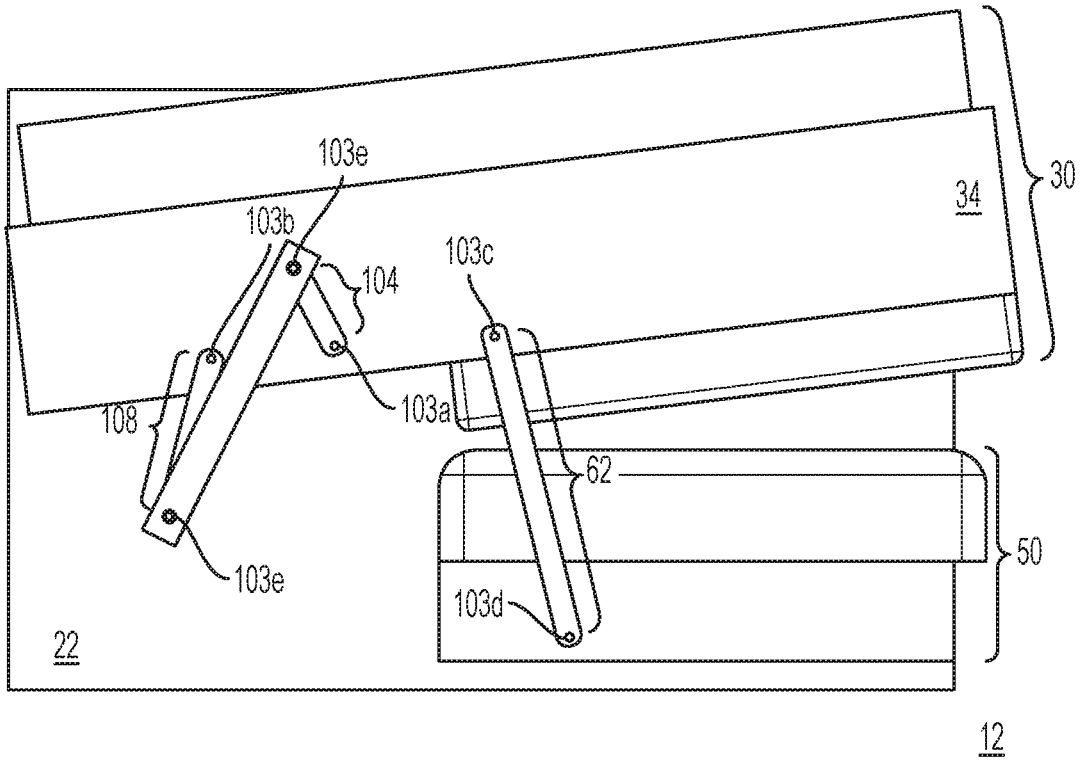
FIG. 15 is a side view of the sofa bed shown in FIG. 14 further into its conversion to bed configuration.

FIGS. 5-16 show a side view of the sofa bed 10 transitioning from a sofa, as shown in FIG. 5, to a bed, as shown in FIG. 16. These figures also illustrate how the folding mechanism 100 and the sliding mechanism 110 of FIG. 17 facilitates the transition. Briefly, the sofa configuration may transition to a bed configuration with the user rotating the backrest 30 so that the rear side 38 faces upward and is parallel to a horizontal plane, and the seat base 50 may be lowered so that the backrest 30 is above the seat base 50. This position is the bed configuration and is shown in FIG. 16. To reverse the transition, the user may pull in the direction of arrow 51 (see FIG. 16) and rotate the backrest 30 upward as shown by arrow 53 in FIG. 16 and raise the seat base 50 along with the backrest 30. These transition processes are briefly touched on here to give context for how the folding and sliding mechanisms 100, 110 operate, and they will be further discussed in detail.

The folding mechanism 100 may be assembled on the sofa bed 10 so that a left first link member 104 and a left second link member 108 are the mirror images of a right first link member 104 and a right second link member 108 about a vertical plane normal to the seat base 50 that bisects the sofa bed 10. The left first and second link members 104, 108 are identical to the right first and second link members but are located on opposite sides of each other. Reference numbers 104, 108 refer to both the first and second link members on the left and right sides. The left and right first link members 104 may be shorter than the left and right second link members 108. The left and right first link members 104 are preferably of a length between 2 inches and 6 inches and most preferably about 3.5 inches, whereas the left and right second link members 108 are preferably of a length between 3 inches to 10 inches and most preferably about 6.5 inches. The link members 104, 108 may be made of a high strength and durable material such as steel or any another material known in the art to have adequate strength and durability. The left and right first link members 104 may be rotatably attached to the left backrest end 32 and the left armrest 20 and the right backrest end 34 and the right armrest 22, respectively. Likewise, the left and right second link members 108 may be rotatably attached to the left backrest end 32 and the left armrest 20 and the right backrest end 34 and the right armrest 22, respectively. The rotatable attachments on the backrest 30 may have pivot points 103*a*, 103*b*, 103*c*, and the rotatable attachments on the seat base 50 may have pivot points 103*d*, and the armrests 20, 22 may have pivot points 103*e* which may also be referred to as joints in a nonlimiting manner. These pivot points 103*a*, 103*b*, 103*c*, 103*d*, 103*e* may be in a variety of forms, such as pivot pins, rivets, and bolt and nut combinations. The pivot points 103*a* of the rotatable attachment of the left and right first link members 104 to the left and right backrest ends 32, 34 may be at a first height 105 above the underlying surface 12. In the bed configuration, the first height 105 (see FIG. 16) may be equal to or within 6 inches of a second height 109 (see FIG. 16) above the underlying surface 12 where the pivot points 103*b* of the rotatable attachment of the left and right second link members 108 to the left and right backrest ends 32, 34 may be located. In the sofa configuration, the first height 105 may be higher than the second height 109 (see FIG. 5).

As shown in FIGS. 5-16, in carrying out the transition from sofa configuration to bed configuration, the folding mechanism 100 may function by left and right first and second link members 104, 108 oscillating the backrest 30 about a left joint 103*b* and a right joint 103*b* that join the left and right backrest ends 32, 34 to the left and right second link members 108 and a left joint 103*a* and a right joint 103*a* that join the left and right backrest ends 32, 34 to the left and right first link members 104 until the backrest rear side 38 is facing upward and is parallel to the horizontal plane. The transition motion may stop when the left and right first link members 104 are parallel to the left and right second link members 108 and normal to the underlying surface 12. All link members 104, 108, and thus the backrest 30 may be at rest because the forces acting on their respective pivot points 103*a*, 103*b* may counter each other and rotational moments may be zero. For example, the moment acting on the backrest due to its combined weight, is counteracted by the reaction force couple generated by the left and right first link members 104 and the left and right second members 108. The folding mechanism 100 is locked and the sofa bed cannot be unintentionally traversed to the sofa configuration once the sofa bed is in the bed configuration. If a user attempts to lift up on the backrest 30 without first pulling the backrest in the direction of arrow 51, the left and right first and second link members 104, 108 lock up, in that they cannot be rotated.

The sliding mechanism 110 may be locked when the sofa bed is in the sofa configuration with a stopping mechanism 120 to further restrict movement of the link members 104, 108, and thus transition of the sofa bed from the sofa configuration to the bed configuration. The sliding mechanism will be further discussed below.

Also in the bed configuration, the left and right first link members 104 may exert a vertical and upward pulling force on the backrest 30 due to the tension applied by the pivot points 103*a* where the first link members 104 and armrests 20, 22 attach together. The magnitude of this force may counter the magnitudes of all other vertical forces exerted on the backrest 30 at a downward direction. These forces may be the vertical component of the force exerted by the front link members 60, 62, the weight of the backrest 30, the downward force on the backrest 30 due to the force applied by the pivot points 103*b*, where the second link members 108 and armrests 20, 22 attach together, and the weight of the user. Thus, the bed configuration may be in a state of static force equilibrium. This equilibrium may be further reinforced by a stopping mechanism 120 to counter the horizontal as well as the vertical component of the force transferred by the front link members 60, 62 on the backrest 30. The stopping mechanism 120 may lock one, multiple, or all of the following, thereby stopping 50 and the backrest 30 from moving in all directions: the sliding mechanism 110, the front link members 60, 62, or the first and second link members 104, 108. The stopping mechanism 120 may be a spring loaded latch 120 engaging with a latch slot or any other locking mechanism appreciated by those with ordinary skill in the art. There may be an upper latch slot 124*a* to allow locking at the sofa configuration and a lower latch slot 124*b* to allow locking at the bed configuration. The latch 120 may not pull out or unlock itself out of the slots 124*a*, 124*b* unless actuated by the user manually or via a control device, such as a button or a switch. The sofa bed may be locked at either the sofa configuration or bed configuration.

Also, as shown in FIGS. 5 and 16 the left and right front link members 60, 62 may hold the seat base 50 at the desired position both in the sofa configuration and the bed configuration. The front link members 60, 62 may be made of a high strength and durable material such as aluminum or another material to have similar strength and durability (e.g., steel). They may preferably have a length between about 5 inches and 20 inches. The left and right front link members 60, 62 may be rotatably attached to the left backrest end 32 and the right seat base end 52 and the left backrest end 32 and the right seat base end 54, respectively. The rotatable attachments may have pivot points 103*c* on the backrest 30 and pivot points 103*d* on the seat base. Pivot points 103*c* may be at a first height 64 from the underlying surface 12, whereas pivot points 103*d* may be at a second height 66 from the underlying surface 12. The first height 64 may be higher than the second height 66 in both sofa and bed configurations (see FIGS. 5 and 16). These pivot points 103*c*, 103*d* may be in a variety of forms, such as pivot pins, rivets, and bolt and nut combinations.

In the sofa configuration, the left and right front link members 60, 62 may be static because the locking mechanism is engaged, and thus the backrest 30 may not tip over toward the bed configuration.

Referring now to FIG. 17, the sliding mechanism 110 may be employed to guide the seat base 50 up and down as the sofa bed is transitioned between the sofa and bed configurations. Although a sliding mechanism is described, other mechanisms in lieu of the sliding mechanism may be used. By way of example and not limitation, the sliding mechanism may be replaced with a profile linear bearing, a four-bar linkage, slots and grooves guiding a peg or nub, and other mechanism that limit or governs the seat base up and down as the sofa bed is transitioned between the sofa configuration and bed configuration. The up and down motion governed by the sliding mechanism or alternate mechanism may be linear or curved.

As mentioned above, the sliding mechanism 110 may be locked at a bottom bed configuration position and a top sofa configuration position with a stopping mechanism 120. The sliding mechanism 110 may have left and right first track members 112, 116 and left and right second track members 114, 118 that mirror each other across the vertical plane bisecting the sofa bed 10. The sliding mechanism 110 may have at least one track member or may have at most ten track members on each side. In the figures, two tracks are shown on each side. The two sets of track members 112, 116, 114, 118 described herein is only one embodiment of the invention and is not intended to be limiting in the quantity of track members that may be used in the sliding mechanism 110. The left first and second track members 112, 116 may connect the left seat base end 52 to the left armrest 20, and the right first and second track members 114, 118 may connect the right seat base end 54 to the right armrest 22. First track members 112, 116 may be parallel to second track members 114, 118 and mounted on the left and right armrest inner surfaces 21, 23 at an angle preferably between 6 to 20 degrees to the vertical plane, and most preferably 12 degrees. However, the angle may be any acute angle to the vertical plane that would allow the seat base to travel down a trajectory to its bed configuration position without being offset with the backrest 30 for more than 3 inches at that position. This may be desirable because the seat base 50 may want to be kept tucked away as much as possible to avoid bumping into it or for stylistic reasons. The track members 112, 114, 116, 118 may be actuated into sliding motion with a spring. The spring may be mechanical or pneumatic. The user may convert the sofa bed 10 from one configuration to the other by exerting less energy when moving the seat base 50 either up or down by allowing the spring to bear some or all of the load.

The left and right first and second track members may be further split into left and right first and second rails 113*a*, 115*a*, 117*a*, 119*a* and left and right first and second sliding members 113*b*, 115*b*, 117*b*, 119*b*. The left rails 113*a*, 117*a* mirror the right rails 115*a*, 119*a* along the vertical plane 20 bisecting the sofa bed 10. The first and second rails 113*a*, 115*a*, 117*a*, 119*a* may be equal in length. The left and right first and second rails 113*a*, 115*a*, 117*a*, 119*a* may be receptive to and slidably engageable with left and right first and second sliding members 113*b*, 115*b*, 117*b*, 119*b*. The left and right first and second rails 113*a*, 115*a*, 117*a*, 119*a* may be mounted on the left armrest inner surface 21 and right armrest inner surface 23, respectively. The mounting may be so that the first and second rails 113, 115, 117, 119 may reach between about 7.875 inches to about 23.625 inches, preferably about 15.75 inches, high from the underlying surface 12. The left and right first and second sliding members 113*b*, 115*b*, 117*b*, 119*b* may be mounted on the left and right seat base ends 52, 54, respectively.

Figure 19:
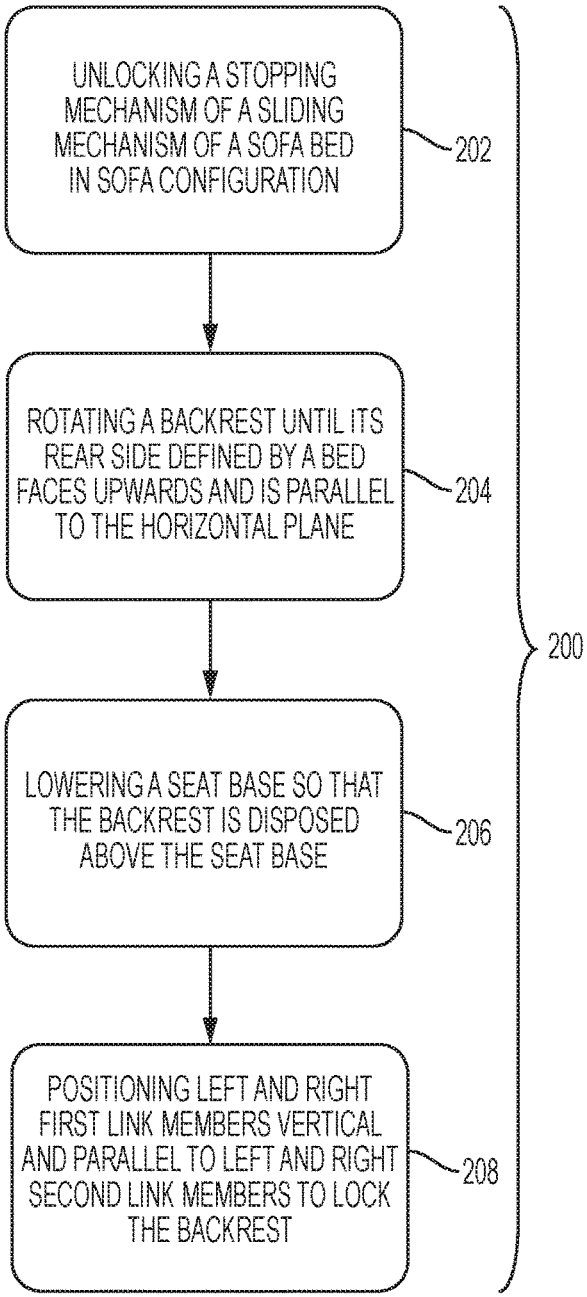
FIG. 19 is a flowchart of a method of converting the sofa bed in sofa configuration (shown in FIG. 1) to the bed configuration (shown in FIG. 3).

FIG. 19 shows a flowchart for a method 200 of converting the sofa bed 10 from a sofa configuration to a bed configuration. The method 200 may include a step 202 of unlocking a stopping mechanism 120 that holds the seat base 50 and the backrest 30 at the sofa configuration at both the left and right counterparts of the sliding mechanism 110. The stopping mechanism 120 may be a spring loaded latch 120 that may be unlocked manually or with button or switch controls and may function as described above. Unlocking the spring loaded latch 120 may involve retracting the latch 120 from the upper latch slot 124*a*, and thereby rendering the sliding mechanism 110 slideable.

The method 200 may next include a step 204 of rotating the backrest 30 until its rear side 38 defined by the bed frame 40 housing the mattress 42 faces upwards and is parallel to the horizontal plane. This is the bed configuration. To traverse the sofa bed back to the sofa configuration, a pulling force 51 on the backrest 30 may be necessary to initiate the rotation of the backrest. The pulling force 51 skews the link members 104, 108 so that the link members 104,108 can be rotated. When the link members 104, 108 are parallel to each other, they cannot be rotated. In this manner, the sofa bed is locked in the bed configuration even without the stopping mechanism 120.

After step 204 is initiated and the back rest is being transitioned to the bed configuration, the method 200 may also include a step 206 of lowering the seat base 50 so that the backrest 30 is disposed above the seat base 50. This step may be simultaneously executed with step 204. Lowering the seat base 50 may be accomplished with the left and right front link members 60, 62, and the sliding mechanism 110 as described above. The track members 112, 116, 114, 118 may be actuated into sliding motion as described above. A spring could be used to help with the lowering of the backrest and the seat base so that the sofa bed does not too quickly fall into the bed configuration. The spring may carry some of the weight of the back rest and seat base so that the back rest can be gently placed or transitioned to the bed configuration.

The method 200 may next include a step 208 of positioning the left and right first link members 104 vertical and parallel to the left and right second link members 108 to virtually lock the backrest 30 at the bed configuration as described above. The locking may be further reinforced by locking a stopping mechanism 120 that holds the seat base 50 and the backrest 30 at the bed configuration at both the left and right counterparts of the sliding mechanism 110. The stopping mechanism 120 may be a spring loaded latch 120 that may be locked and may function as described above. Locking the spring loaded latch 120 may involve inserting the latch 120 to the lower latch slot 124*b*, and thereby rendering the sliding mechanism 110 non-slidable.

Figure 20:
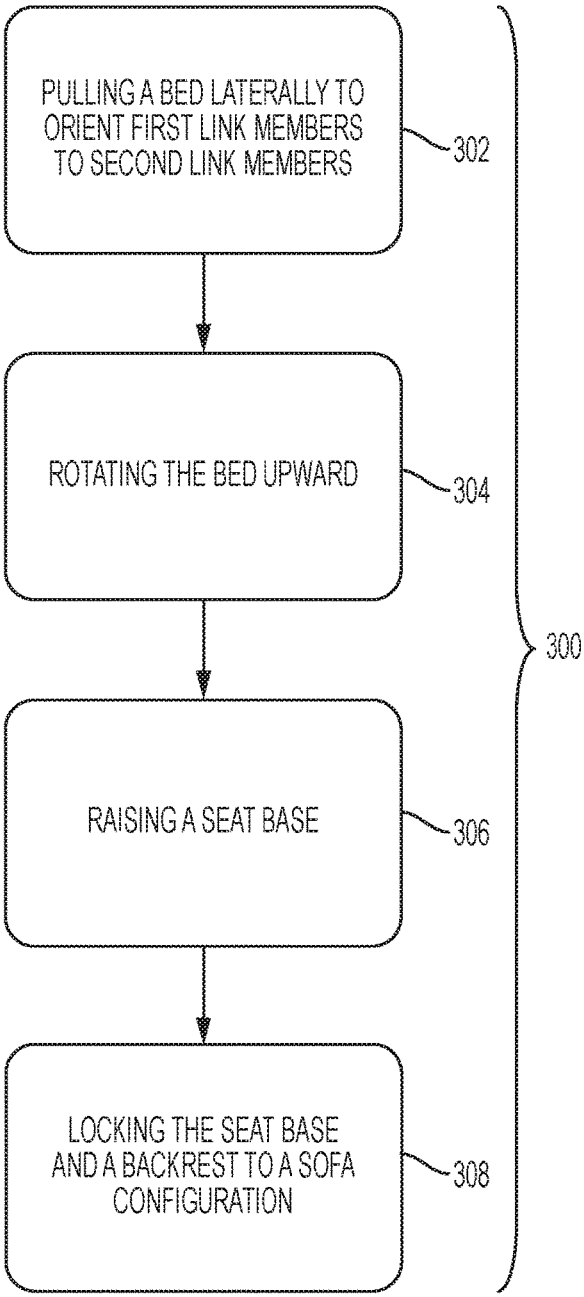
FIG. 20 is a flowchart of a method of converting the sofa bed in bed configuration (shown in FIG. 3) to the sofa configuration (shown in FIG. 1).

FIG. 20 shows a flowchart for a method 300 of converting the sofa bed 10 from a bed configuration to a sofa configuration. The method 300 may include a step 302 of pulling a bed frame 40 defined by a backrest 30 laterally to skew left and right first link members 104 to left and right second link members 108 for unlocking the sofa bed 10 from the bed configuration to the sofa configuration. This skewed orientation of the link members 104, 108 may be necessary to allow link members 104, 108 to rotate about their pivot points 103*a*, 103*b*. The user may initiate the pulling by applying a horizontal force 51 on the backrest 30. This may involve the user standing in front of the sofa bed 10, grabbing the bed frame 40, and pulling the backrest 30 towards the user. The user may stop pulling when the left and right first link members 104 are skewed with respect to each other.

The method 300 may next include a step 304 of rotating the bed frame 40 upward in the direction of arrow 53. This may require the user to apply a vertical force on the backrest 30. The user may achieve this by standing in front of the sofa bed 10, grabbing the bed frame 40, and pulling up on the backrest 30 away from the underlying surface 12.

The method 300 may next include a step 306 of raising the seat base 50. This step may be simultaneously executed with step 304. Raising the seat base 50 may be accomplished with the left and right front link members 60, 62 and the sliding mechanism 110 as described above. The backrest may be assisted toward into the upward motion with a spring as described above. The seat base may also be raised manually, without the assistance of links or springs. For example, the user can apply an upward force onto the seat base. If a stopping mechanism is included in the sofa bed, then the upward force will move the seat base upward toward the sofa configuration after disengaging the stopping mechanism.

The method 300 may next include a step 308 of locking the seat base 50 and the backrest 30 to a sofa configuration. This step may be executed by locking the stopping mechanism 120 at both the left and right counterparts of the sliding mechanism 110. The stopping mechanism 120 may be a spring loaded latch 120 that may be locked and may function as described above. Locking the spring loaded latch 120 may involve inserting the latch 120 to the upper latch slot 124*a*, and thereby rendering the sliding mechanism 110 non-slidable. In lieu of or in addition to the stopping mechanism, the sofa bed may be retained in the sofa configuration when the center of gravity of the back rest crosses over a rotational point of the back rest which occurs between the link members 104, 108. The weight of the back rest and the distance of the center of gravity of the back rest to the center of gravity creates a moment greater than the weight of the seat base so that even without the stopping mechanism the sofa bed stays in the sofa configuration.

The detailed description set forth below in connection with the appended drawings is intended as a description of certain embodiments of the present disclosure and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as "top," "bottom," "left," "right," "first," "second," and the like are used solely to distinguish one entity from another without necessarily requiring or implying any actual such relationship or order between such entities. Also, where used, the terms "secured," "attached," connected," "mounted," "coupled," and the like can mean either direct or indirect attachment or contact between elements, unless stated otherwise.

The above description is given by way of example, and not limitation. Given the above disclosure, one skilled in the art could devise variations that are within the scope and spirit of the invention disclosed herein, including various ways of attaching the folding mechanisms to the support members. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A convertible sofa bed with a folding mechanism capable of traversing the sofa bed between a sofa configuration and a locked bed configuration, the bed being in the locked bed configuration, the sofa bed comprising:

a left support member and a right support member, both configured to rest on an underlying surface;

a backrest having a left end and a right end, the backrest being horizontally disposed between the left support member and the right support member, wherein the left end is attached to the left support member and the right end is attached to the right support member and wherein the backrest is configured to pivot up when the sofa bed is traversed to the sofa configuration and pivot down when the sofa bed is traversed to the bed configuration, the backrest having a front side and a rear side, the rear side defining a bed frame, the bed frame being engageable with a mattress;

a seat base having a left end and a right end attached to the backrest; and the folding mechanism comprising:

a left first link member rotatably attached to the left backrest end about a first pivot point and the left support member about a second pivot point wherein the first and second pivot points define a first straight line, and a right first link member rotatably attached to the right backrest end about a third pivot point and the right support member about a fourth pivot point wherein the third and fourth pivot points define a second straight line;

a left second link member rotatably attached to the left backrest end about a fifth pivot point and the left support member about a sixth pivot point wherein the fifth and sixth pivot points define a third straight line, and a right second link member rotatably attached to the right backrest end at a seventh pivot point and the right support member at an eighth pivot point wherein the seventh and eighth pivot points define a fourth straight line;

wherein the second pivot point, the sixth pivot point, the fourth pivot point and the eighth pivot point define a plane; and wherein the first and second straight lines are parallel to third and fourth straight lines and the first and third pivot points are on the opposite side of the plane from the fifth and seventh pivot points when the sofa bed is in the locked bed configuration so that the rotational moment as a result of the weight of the backrest, along with the weight of any person resting on it, and the weight of the seat base, is counteracted by the moment resulting from the reaction force couple generated by the left and right, first and second, link members to prevent any further rotational movement of the backrest in the locked bed configuration when the user is lying down on the mattress.

2. The sofa bed of claim 1, wherein the left and right first link members are shorter than the left and right second link members.

3. The sofa bed of claim 1, further comprising a sliding mechanism attached to the seat base for guiding the seat base between the sofa and bed configurations.

4. The sofa bed of claim 3, wherein the sliding mechanism is lockable with a stopping mechanism.

5. A method of traversing a convertible sofa bed with a folding mechanism from a sofa configuration to a locked bed configuration, the method comprising the steps of:

unlocking a lock that holds a seat base and a backrest at a sofa configuration;

rotating a backrest from the sofa configuration to the locked bed configuration, the backrest having a rear side defining a bed frame to a horizontal position, wherein the rear side faces upwards in the bed configuration;

lowering the seat base so that the backrest is disposed above the seat base when the sofa bed is in the bed configuration; and positioning first and second straight lines defined by first, second, third and fourth pivot points of left and right first link members which are vertical and parallel to third and fourth straight lines defined by fifth, sixth, seventh and eighth pivot points of left and right second link members wherein the first and third pivot points are on the opposite side of a plane from the fifth and seventh pivot points to lock the bed frame at the bed configuration to prevent any further rotation of the backrest beyond the bed configuration when the backrest is in the locked bed configuration the plane defined by the second, sixth, fourth and eighth pivot points.

6. The method of claim 5 wherein the back rest is biased to a bed configuration with a weight of the back rest.

7. The method of claim 5, wherein the lock is unlocked by disengaging a spring loaded latch from a latch slot.

8. The method of claim 5, wherein application of a horizontal pulling force and moving the backrest horizontally toward a user to skew the first and second link members on the backrest is necessary to initiate the rotation of the backrest back to the sofa configuration from the bed configuration and the necessary force decreases in magnitude following the backrest tipping over a 90-degree angle to a horizontal plane.

9. The method of claim 5, wherein the sliding seat base is aided by left and right front link members connecting the backrest to the seat base rocking towards the seat base and moving the seat base downwards, and out of the way, during the transition from the sofa configuration to the bed configuration.

10. A method of traversing a convertible sofa bed with a folding mechanism from a bed configuration to a sofa configuration, the method comprising the steps of:

pulling a bed frame defined by a backrest laterally to orient first and second straight lines defined by first, second, third and fourth pivot points of left and right first link members from a parallel orientation to each other to a skewed orientation to each other with respect to the third and fourth straight lines defined by fifth, sixth, seventh and eighth pivot points of left and right second link members for unlocking the sofa bed from the bed configuration wherein, when the first and second straight lines are in parallel orientation to each other, the first and third pivot points are on the opposite side of a plane from the fifth and seventh pivot points, the plane defined by the second, sixth, fourth and eighth pivot points;

rotating the bed frame upward;

raising a seat base; and locking the seat base and the backrest to a sofa configuration.

11. The method of claim 10, wherein the bed frame is pulled until the left and right first link members are no longer at a 90-degree angle to a horizontal plane.

12. The method of claim 10, wherein pulling and moving the bed frame horizontally toward a user involves applying a force on the bed frame that has a horizontal magnitude, and rotating the bed frame upward involves applying a force on the bed frame that has a vertical magnitude.

13. The method of claim 10, wherein the seat base is raised by sliding left and right first and second sliding members at an angle to the vertical plane along left and right first and second rails.

14. The method of claim 13, wherein the seat base is raised at 12 degrees to the vertical plane.

15. The method of claim 10, wherein the seat base is locked by engaging a spring loaded latch with a latch slot.

* * * * *